US006091389A

United States Patent [19]

Maeda et al.

[11] Patent Number: 6,091,389

[45] **Date of Patent: *Jul. 18, 2000**

[54] DISPLAY CONTROLLING APPARATUS

[75] Inventors: Mitsuru Maeda, Yokohama; Tadashi Yoshida, Ichikawa, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/509,177

[22] Filed: Jul. 31, 1995

Related U.S. Application Data

[63] Continuation of application No. 08/098,810, Jul. 29, 1993, abandoned.

[30] Foreign Application Priority Data

| | | | |
|---|---|---|---|
| Jul. 31, 1992 | [JP] | Japan | 4-204936 |
| Jul. 31, 1992 | [JP] | Japan | 4-205416 |
| Jul. 31, 1992 | [JP] | Japan | 4-205540 |

[51] Int. Cl.[7] ..... G09G 3/36

[52] U.S. Cl. ..... 345/98; 345/103; 345/100

[58] Field of Search ..... 345/98, 99, 100, 345/87, 89, 90, 92, 97, 103, 104

[56] References Cited

U.S. PATENT DOCUMENTS

| | | | |
|---|---|---|---|
| 4,112,333 | 9/1978 | Asars et al. | 345/90 |
| 4,359,729 | 11/1982 | Nonomura et al. | 345/98 |
| 4,517,606 | 5/1985 | Yokomizo et al. | 358/280 |
| 4,964,699 | 10/1990 | Inoue | 350/332 |
| 5,091,723 | 2/1992 | Kanno et al. | 345/97 |
| 5,111,195 | 5/1992 | Fukuoka et al. | 345/90 |
| 5,119,084 | 6/1992 | Kawamura et al. | 345/98 |
| 5,130,819 | 7/1992 | Ohta | 358/445 |
| 5,189,407 | 2/1993 | Mano et al. | 345/88 |
| 5,264,839 | 11/1993 | Kanno et al. | 345/98 |

FOREIGN PATENT DOCUMENTS

| | | |
|---|---|---|
| 0261901 | 3/1988 | European Pat. Off. . |
| 0368117 | 5/1990 | European Pat. Off. . |
| 0435701 | 7/1991 | European Pat. Off. . |
| 3129026 | 3/1982 | Germany . |

*Primary Examiner*—Xiao Wu

*Attorney, Agent, or Firm*—Fitzpatrick, Cella, Harper & Scinto

[57] ABSTRACT

An image is displayed excellently by partially rewriting the image on the display. A display controlling apparatus for displaying an image on the display having a memory function includes an input device for inputting for image signal, a memory for storing the input image signal, a differential calculator for calculating the differential value between the input image signal and an image signal input before a unit time at the same location stored in the memory, and a partial rewrite controller for creating a partial rewrite signal of the display from the differential value.

37 Claims, 13 Drawing Sheets

| | | |
|---|---|---|
| 1 | 2 | 1 |
| 2 | 4 | 2 |
| 1 | 2 | 1 |

DISPLAY CONTROLLING APPARATUS

This application is a continuation, of application Ser. No. 08/098,810, filed Jul. 29, 1993, now abandoned.

BACKGROUND OF THE INVENTION

1. Field of the Invention

The present invention relates to a display controlling apparatus, and particularly to a display controlling apparatus suitable for controlling a display having a memory function for displaying an image at a lower frequency than the frame frequency of an input image signal, for example, a ferroelectric liquid crystal display (hereinafter abbreviated to as FLCD).

2. Related Background Art

First, FLCD will be described briefly. FLCD is a display using a liquid crystal, characterized in that each pixel itself of the display has a memory, whereby each pixel cell can hold its display state without application of electric field, with the display state of each pixel being changed by applying an electric field. FLCD is expected as a display in the next generation because it is easily manufactured into a large screen.

Recently, several binarization methods have been developed, including an error diffusion method and an average density preservation method, whereby a high quality binary image can be obtained even though the image may contain characters, line figures and natural images mixed with each other.

FLCD can not operate at the display speeds of high definition, for example, 60 Hz non-interlace for the image size of 1280×1024, due to its characteristics. In particular, for computer display outputs from the work station which has recently advanced for higher definition, FLCD can not follow the cursor movement of a mouse requiring the interactiveness, with a frame frequency of about ¼, so that the operator may feel unpleasant because the operation efficiency is decreased.

Thus, a method has been devised, with improved apparent frequency, in which the display state is altered for only the changed portion between frames by making effective use of the memory function of the FLCD.

FIG. 2 shows the relation between a computer and a display. 10 is a computer main unit, comprised of a CPU and peripheral units such as a memory and a disk. From the computer main unit, an image signal 11 for display is output. Normally, the image signal 11 is a digital signal, or an analog signal, such as an NTSC composite signal, a component RGB signal and a non-interlace signal. 30 is an FLCD. 20 is an image process unit, according to the present invention, for inputting an RGB analog signal 11 from the computer main unit 10 for the conversion into digital signal 12, one bit for each RGB, which is then output to the FLCD 30. The FLCD 30 inputs the digital RGB signal 12 for the display from the image process unit 20.

However, in the configuration as shown in FIG. 2, the output from the computer 10 is an analog signal of 60 Hz non-interlace with the image signal 11 corresponding to the size of 1280×1024, for example, wherein information regarding the shape of cursor or the movement from (X0, Y0) to (X1, Y1) is not specifically given, even though the cursor is moved as shown in FIG. 6. That is, no information regarding the area to change the display state to effect the fast display is supplied from the computer.

Hence, such information must be extracted out of the input image data.

In particular, when the image data is displayed through quantization, it is a problem how to extract the area to change the display state.

On the other hand, a technique for switching between the intraframe coding and the interframe coding depending on whether or not the display state is changed has been described in a newly filed application based on Japanese Patent Application Nos. 4-149470 and 4-292214.

However, the above-cited technique needed no information as to which area of the screen was changed. Therefore, it could not detect such changed area which is of concern in the present invention.

SUMMARY OF THE INVENTION

In light of the aforementioned affairs, an object of the present invention is to display an excellent image by partially rewriting a display image.

To achieve such object, according to the present invention, there is disclosed a display controlling apparatus comprising, input means for inputting image data for each pixel;

process means for processing the image data input by said input means; and input means for outputting a control signal for controlling a display;

wherein said process means includes detection means for detecting a partial area of the display which is to be rewritten based on a first image and a second image represented by first image data and second image data successively input by said input means.

Also, it is another object of the present invention to detect image area to be rewritten in the display image excellently.

To achieve such object, according to the present invention, there is disclosed a display controlling apparatus comprising, input means for inputting image data for each pixel;

process means for processing the image data input by said input means; and output means for outputting a control signal for controlling a display;

wherein said process means includes quantization means for quantizing the image data input by said input means and generating quantized image data; and detection means for detecting a partial area of the display which is to be rewritten based on a first quantized image data and a second quantized image data, each of which represents a first image and a second image, respectively, successively quantized by said quantization means.

Also, to achieve such object, according to the present invention, there is disclosed a display controlling apparatus comprising, input means for inputting multi-level image data for each pixel;

process means for processing the multi-level image data input by said input means; and output means for outputting a control signal for controlling a display;

wherein said process means includes detection means for detecting a partial area of the display which is to be rewritten based on a first image and a second image represented by first multi-level image data and second multi-level image data successively input by said input means; and quantization means for quantizing the multi-level image data and generating quantized image data which is used as reproduction data;

wherein said detection means detects the partial area based on the multi-level image data which has not been quantized by said quantization means.

Also, it is another object of the present invention to detect reproduction data and rewrite control data excellently.

To achieve such object, according to the present invention, there is disclosed a display controlling apparatus comprising, input means for inputting image data for each pixel;

process means for processing the image data input by said input means; and output means for outputting a control signal for controlling a display;

wherein said process means includes first quantization means for quantizing the image data input by said input means in accordance with a first quantization parameter and generating first quantized image data which is used as reproduction data;

second quantization means for quantizing the image data input by said input means in accordance with a second quantization parameter and generating second quantized image data, and detection means for detecting a partial area of the display which is to be rewritten based on the second quantized image data quantized by said second quantization means.

It is a further object of the present invention to display color image excellently.

To achieve such object, according to the present invention, there is disclosed a display controlling apparatus comprising, input means for inputting a plurality of color component signals for each pixel;

process means for processing the color component signals input by said input means; and output means for outputting a control signal for controlling a display;

wherein said process means includes detection means for detecting a partial area of the display which is to be rewritten based on a first color image and a second color image represented by first color component signals and second color component signals successively input by said input means.

Other objects and forms of the present invention will be apparent from the following description with reference to the drawings and the claims.

DESCRIPTION OF THE PREFERRED EMBODIMENTS

The embodiments 1 to 3 of the present invention as set forth below each comprise storage means for storing image data before unit time when displaying image on a display having a memory function, differential calculation means for calculating the differential between input image signal and stored image signal at the same location, binarization means for binarizing a result of said differential calculation means at a threshold, whereby the precision of determining the partial rewrite area is enhanced by determining the partial rewrite area of the display which is to be rewritten from binarized data obtained by said binarization means.

Also, signal conversion means for converting input image signal is provided to improve the detection precision of a pointing mark such as a cursor, as represented mainly in black and white.

Further, means for smoothing input image is provided to reduce influence with noise.

Specific embodiments will be now described.

(First embodiment)

Figure 1:
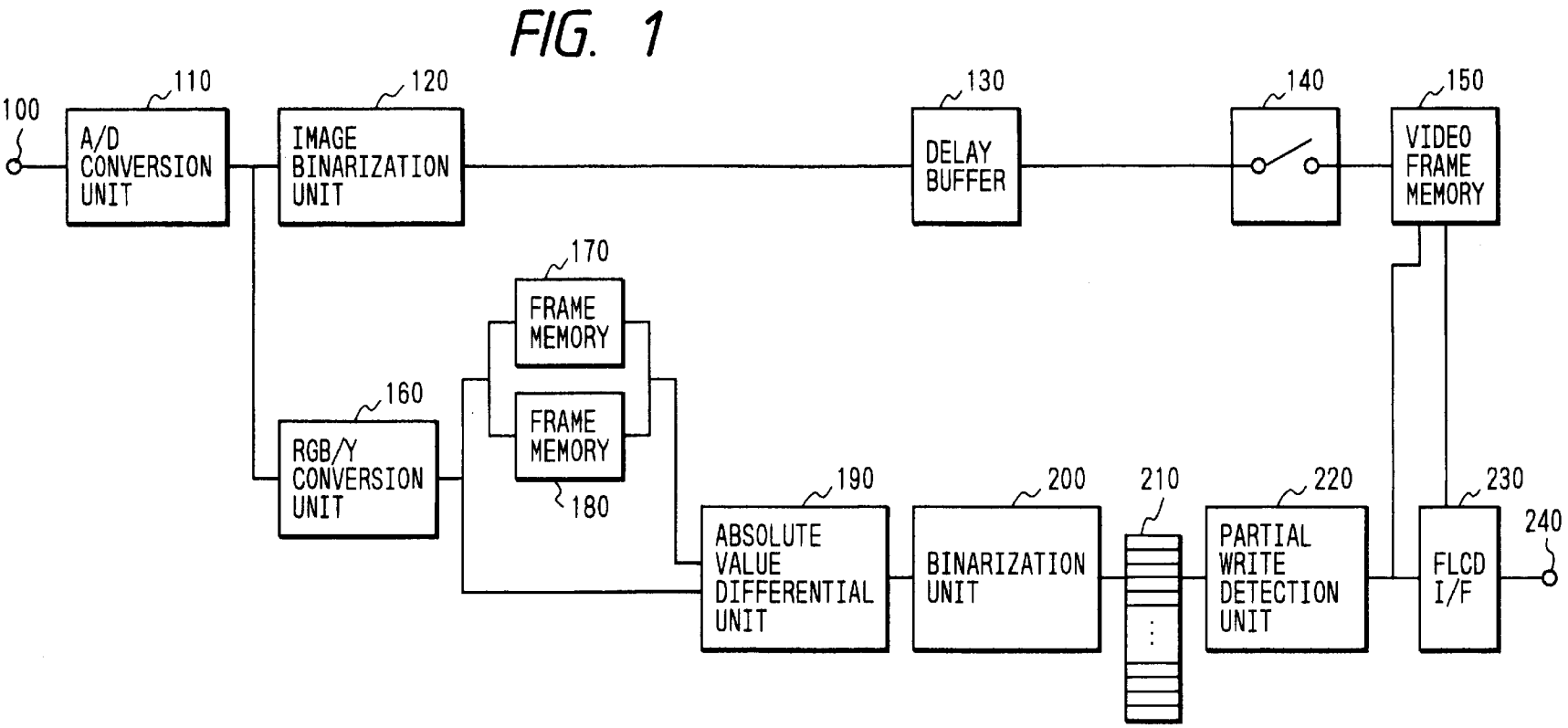
FIG. 1 is a block diagram showing the configuration of a display controlling apparatus according to the first embodiment.

FIG. 1 is a diagram showing the configuration of an image process unit in an image display system according to this embodiment.

In this embodiment, input signal is supposed to be a non-interlace 60 Hz signal of component RGB.

In FIG. 1, 100 is an input terminal for RGB analog output signal 11 from a computer 10, and 110 is an A/D conversion unit for A/D converting an RGB analog signal as input to create multi-value digital RGB signal. RGB analog signal is a 60 Hz non-interlace signal. 120 is an image binarization unit for converting multi-value RGB digital signal into a signal, one bit for each RGB. The binarization technique for the image used herein is an error diffusion method suitable for representing the half tone. 130 is a delay buffer composed of a FIFO memory to effect synchronization. 140 is a switch which is turned on or off by a predetermined control signal. 150 is a frame memory for storing data, one bit for each RGB, of each pixel, and which is comprised of, for example, a two-port RAM. 160 is an RGB/Y conversion unit for generating multi-value Y signal which is a luminance signal from multi-value digital RGB signal. 170, 180 are frame memories for storing Y signal, and 190 is an absolute value differential unit for calculating the absolute value differential between input Y signal and Y signal before one frame stored in a frame memory 170 or 180. 200 is a binarization unit for binarizing multi-value absolute differential values. The binarization technique used herein is a simple binarization for effecting binarization by making a comparison with a prefixed threshold. 210 is a line flag memory for enabling a flag to be turned on or off for each scan line. 220 is a partial write detection unit for detecting whether or not the partial write is performed from the content of line flag memory 190 as well as controlling the location of partial write. 230 is an FLCD interface for reading the control of video frame memory 150 for the output to the FLCD 30 via a terminal 240.

RGB analog signal of 60 Hz non-interlace from the computer 10 is input into the A/D conversion unit 110 via the terminal 100. Input multi-value RGB analog signal is A/D converted into multi-value RGB digital signal in the A/D conversion unit 110 for the input to image binarization unit 120 and RGB/Y conversion unit 160. The image binarization unit 120 binarizes input multi-value RGB signal for each color in succession by using the error diffusion method. Its result is stored in the delay buffer 130.

On the other hand, multi-value RGB digital signal input into the RGB/Y conversion unit 160 is converted into a Y signal for each pixel in succession. The conversion from RGB signal into the Y signal is performed based on an expression:

$$Y=0.299\times R+0.587\times G+0.114\times B$$

The Y signal is input into the absolute value differential unit 190, and at the same time written into the frame memory 170 or 180. The frame memories 170 and 180 are subjected to alternating operation of writing and reading in the unit of frame, that is, while one of them is written, the other is read.

The absolute value differential unit 190 calculates the absolute value of the differential between the Y signal input from the RGB/Y conversion unit 160 and the Y signal before one frame at the same location written into the frame memory 170 or 180.

The absolute value of the differential of Y signal input into the binarization unit 200 is compared with a prefixed threshold TH for the binarization. If the absolute value of the differential is greater than the threshold TH, 1 is output, or otherwise, 0 is output.

It suffices that the threshold TH is a greater value than the analog noise of input RGB signal. There are various methods for determining the threshold TH. For example, an analog signal of single luminance (herein, 128 is supposed) output beforehand is input to the terminal 100, converted into digital data in the A/D conversion unit 110, input into the RGB/Y conversion unit 160 for the conversion into the Y signal, and written into the frame memory 170. The absolute value differential unit 190 calculates the absolute value differential from the fixed value (herein, 128 is supposed), but not the input from the RGB/Y conversion unit 160, with its maximum value determined as the threshold TH.

If the binarized Y signal is 1, it is extracted as the change point. Before starting the process of scan lines, corresponding flags in the line flag memory 210 are reset. The presence of change point is detected in the unit of line, and if at least one change point is extracted in a line of interest, the flag of the line flag memory 210 corresponding to the scan line of interest is set. If no change point exists within one scan line, the flag set in the line flag memory 210, if any, is reset.

The partial write detection unit 220 monitors the flag status in the line flag memory 210, and if any flag is set, the partial write for the corresponding scan line is performed.

In performing the partial write, the switch 140 is turned on, and location information concerning the scan line for the partial write is transmitted to the video frame memory 150 and the FLCD interface unit 230. As a result, binarized RGB signal of a scan line corresponding to the scan line at which a change point is detected is read from the delay buffer 130, and written into the video frame memory 150. Further, the FLCD interface 230 reads RGB binarization signals of corresponding scan lines in the video frame memory 150 to change the display states of the corresponding scan lines of the FLCD 30 based on the scan line data of the FLCD 30.

If no flag is set in the line flag memory 210, the partial write detection unit 220 turns off the switch 140, wherein no partial write for RGB binarization signal of the corresponding scan line is performed. In this way, the display state for only the portion that has been changed is altered.

(Second embodiment)

Figure 3:
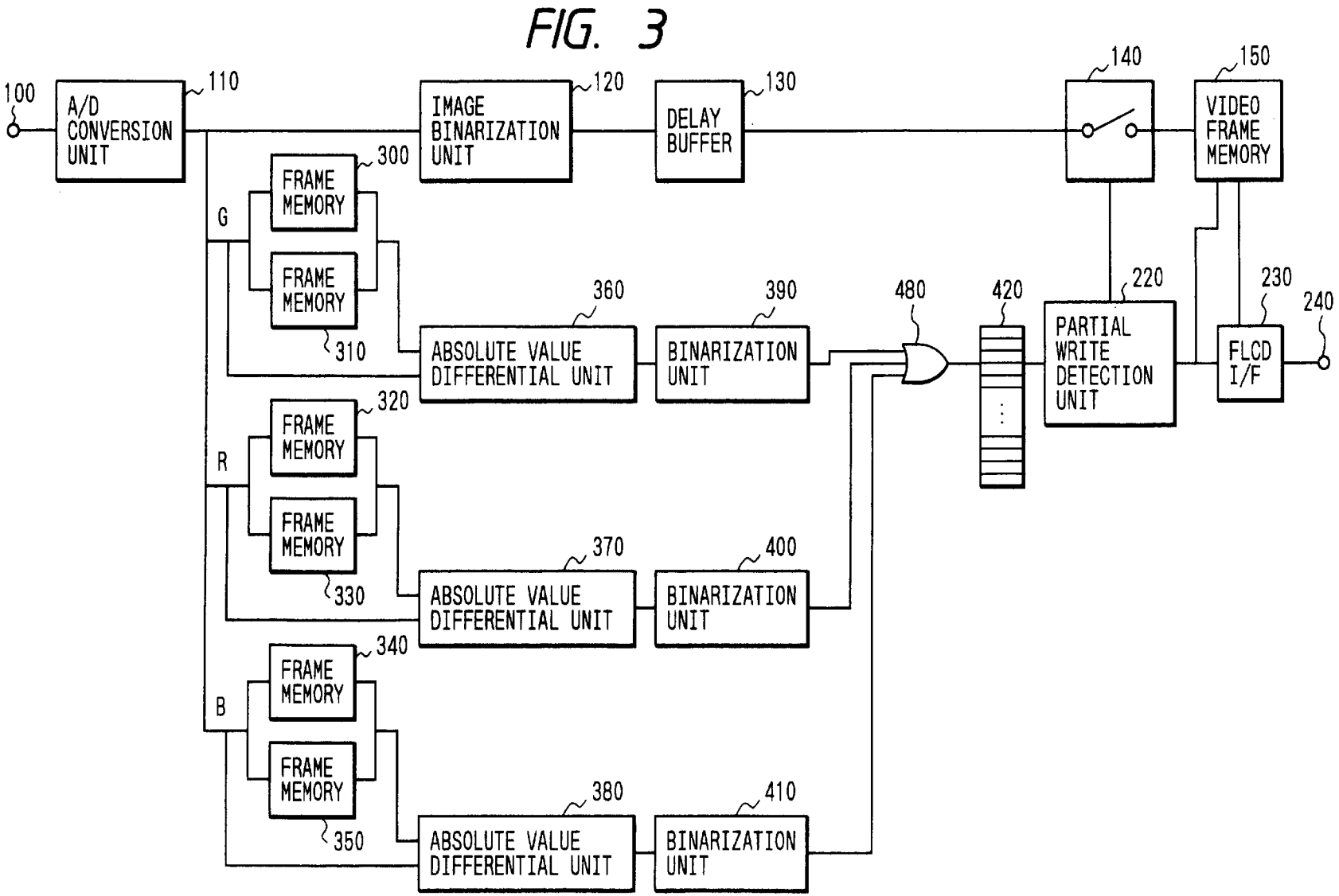
FIG. 3 is a block diagram showing the configuration of a display controlling apparatus according to the second embodiment.

FIG. 3 is a diagram showing the configuration of an image process unit in an image display system according to this embodiment. In FIG. 3, like numerals refer to the parts having the same functions as in FIG. 1 of the embodiment 1. 300 to 350 are frame memories. 360, 370, 380 are absolute value differential units for calculating the absolute value of the differential between frames by making a comparison between input multi-value signal and multi-value signal before one frame stored in the frame memory. 390, 400, 410 are binarization units for the image, and 420 is an OR circuit.

RGB analog signal of 60 Hz non-interlace from the computer 10 is input into the A/D conversion unit 110 via the terminal 100. Input multi-value RGB analog signal is A/D converted into multi-value RGB digital signal in the A/D conversion unit 110 for the input to image binarization unit 120, R multi-value signal being input into a frame memory 320 or 330, G multi-value signal into a frame memory 300 or 310, and B multi-value signal into a frame memory 340 or 350. The frame memories 300 and 310, the frame memories 320 to 330, and the frame memories 340 and 350, are subjected to alternating operation of writing and reading in the unit of frame, that is, while one of them is written, the other is read.

The image binarization unit 120 binarizes input multi-value RGB signal for each color in succession by using the error diffusion method. Its result is stored in the delay buffer 130.

The absolute value differential unit 360 calculates the absolute value of the differential between the R signal input from the A/D conversion unit 110 and the R signal before one frame at the same location written into the frame memory 170 or 180.

The absolute value of the differential between R signals input into the binarization unit 360 is compared with a fixed threshold $TH_R$ for the binarization. If the absolute value of the differential is greater than the threshold $TH_R$, 1 is output, or otherwise, 0 is output.

It suffices that the threshold $TH_R$ is a greater value than the analog noise.

In the same way, change points for B signal and G signal are also detected.

The outputs from the R signal binarization unit 390, G signal binarization unit 400 and B signal binarization unit 410 are input into an OR circuit 480. The OR circuit 420 calculates a logical sum of these inputs for the output to the line flag memory 210.

Before starting the process of scan lines, corresponding flags in the line flag memory 210 are reset. If the output of the OR circuit 420 is 1, the flag in the line flag memory 210 corresponding to the scan line of interest is set.

The partial write detection unit 220 monitors the flag status in the line flag memory 210, and if any flag is set, the partial write for the corresponding scan line is performed.

In performing the partial write, the switch 140 is turned on, and location information concerning the scan line for the partial write is transmitted to the video frame memory 150 and the FLCD interface unit 230. As a result, the binarized RGB signal of a scan line corresponding to the scan line at which change point is detected is read from the delay buffer 130, and written into the video frame memory 150. Further, the FLCD interface 230 reads RGB binarization signals of corresponding scan lines in the video frame memory 150 to change the display states of the corresponding scan lines of the FLCD 30 based on the scan line data of the FLCD 30.

If no flag is set in the line flag memory 210, the partial write detection unit 220 turns off the switch 140, wherein no partial write for RGB binarization signal of the corresponding scan line is performed. In this way, the display state for only the portion that has been changed is altered.

(Third embodiment)

Figure 4:
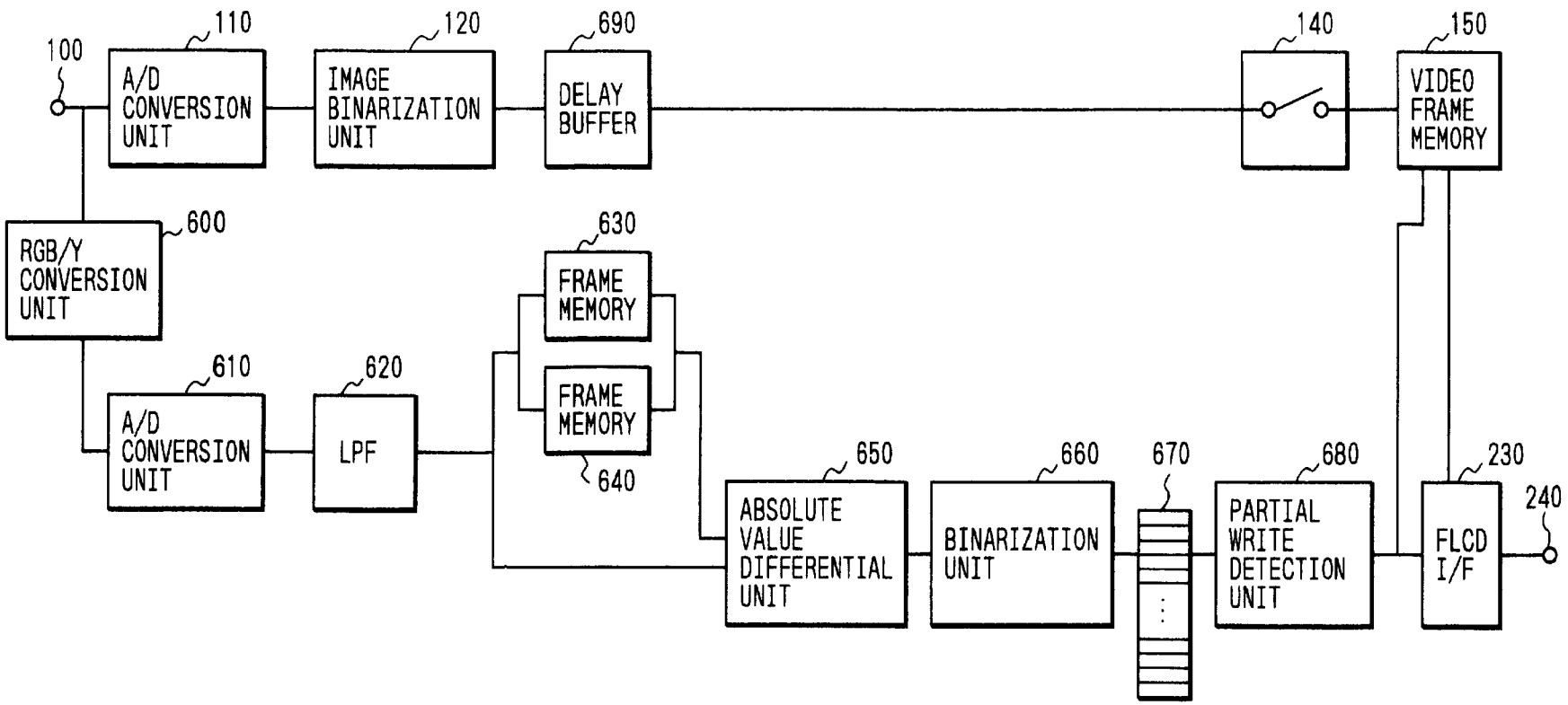
FIG. 4 is a block diagram showing the configuration of a display controlling apparatus according to the third embodiment.
Figures 5, 6:
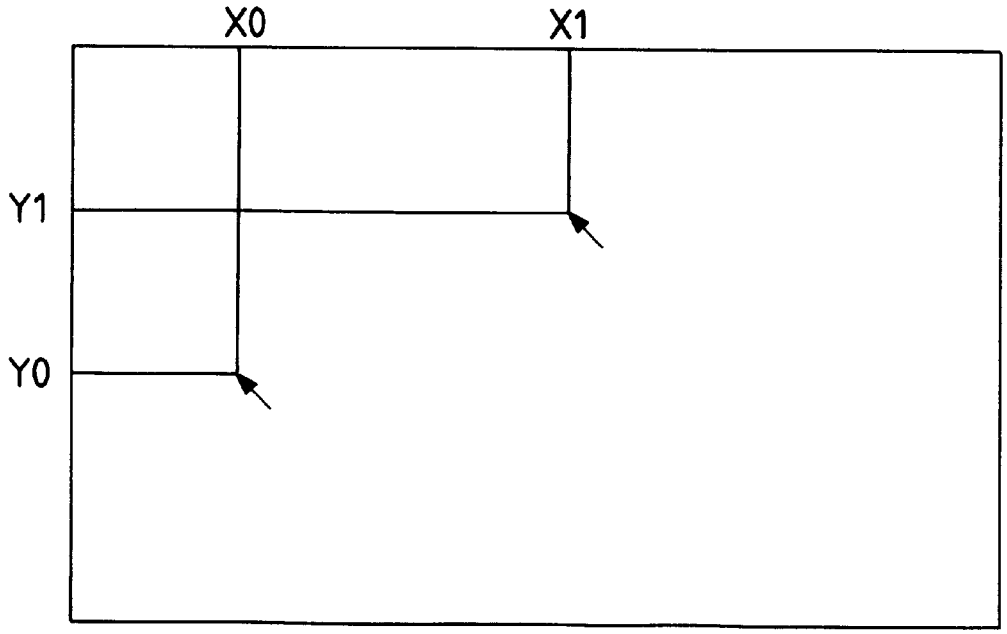
FIG. 5 is a diagram showing a low pass filter useful for the smoothing according to the third embodiment.
FIG. 6 is a diagram showing the movement of the cursor.

FIG. 4 is a diagram showing the configuration of an image process unit in an image display system according to this embodiment. In FIG. 4, like numerals refer to the parts having the same functions as in FIG. 1 of the embodiment 1. 600 is an analog RGB/Y conversion unit for generating analog Y signal which is a luminance signal from analog RGB signal. 610 is an A/D conversion unit for A/D converting analog Y signal to create a multi-value digital Y signal. 620 is a low pass filter unit for effecting low pass filter process as shown in FIG. 5 to subsample scan lines odd-numbered. 630, 640 are frame memories having one-half the image size of display in vertical and horizontal directions. 650 is an absolute value differential unit for calculating the absolute value differential between input Y signal and Y signal before one frame stored in the frame memory 630 or 640. 660 is a binarization unit for binarizing the multi-value absolute value differential. The binarization technique used herein is a simple binarization by comparison with a fixed threshold.

670 is a line flag memory the flags of which can be turned on or off for each scan line odd-numbered. 680 is a partial write detection unit for detecting whether or not the partial write is performed from the content of the line flag memory 670 to control the partial write such as the location of partial write. 690 is a delay buffer.

RGB analog signal of 60 Hz non-interlace from the computer 10 is input into the A/D conversion unit 110 and the RGB/Y conversion unit 600 via the terminal 100. Input multi-value RGB analog signal is A/D converted into multi-value RGB digital signal in the A/D conversion unit 110 for the input to image binarization unit 120. The image binarization unit 120 binarizes input multi-value RGB signal for each color in succession by using the error diffusion method. Its result is stored in the delay buffer 690.

On the other hand, the RGB/Y conversion unit 600 converts input RGB analog signal into analog Y signal for the output to the A/D conversion unit 610. The A/D conversion unit 610 A/D converts analog Y signal to create multi-value digital Y signal for the input into the low pass filter unit 620.

The low pass filter unit 620 performs the low pass filter process to subsample the scan lines odd-numbered at half the frequency. The Y signal subjected to low pass filtering is written into the frame memories 630 or 640. The frame memories 630 and 640 are subjected to alternating operation of writing and reading in the unit of frame, that is, while one of them is written, the other is read.

The absolute value differential unit 650 calculates the absolute value of the differential between the R signal input from the RGB/Y conversion unit 610 and the Y signal before one frame at the same location written into the frame memory 630 or 640.

The absolute value of the differential between Y signals input into the binarization unit 660 is compared with a fixed threshold TH for the binarization. If the absolute value of the differential is greater than the threshold TH, 1 is output, or otherwise, 0 is output.

If binarized Y signal is 1, it is extracted as the change point. Before starting the process of scan lines, corresponding flags in the line flag memory 210 are reset. If change point is extracted, the flag in the line flag memory 210 corresponding to the scan line of interest is set. If no change point exists within one scan line, the flag set in the line flag memory 210, if any, is reset.

The partial write detection unit 220 monitors the flag status in the line flag memory 210, and if any flag is set, the partial write for corresponding scan lines is performed.

In performing the partial write, the switch 140 is turned on, and location information concerning the scan line for the partial write is transmitted to the video frame memory 150 and the FLCD interface unit 230. If no partial write is performed at the previous scan line odd-numbered in the line flag memory 670, the partial write detection unit 680 reads data for the scan line of interest odd-numbered and data for the scan lines even-numbered located before and after the scan line of interest from the delay buffer 690. The location of the scan line of interest odd-numbered and the locations of the scan lines even-numbered before and after that scan line of interest are transmitted to the video frame memory 150 as the location information, and also transmitted to the FLCD interface 230 at the same time when data is written. RGB binarization signal of the scan line of interest in the video frame memory 150 is read to change the display state of the scan line of interest in the FLCD 30, with the scan line data of the FLCD 30.

If no flag is set in the line flag memory 670, the partial write detection unit 680 turns off the switch 140, wherein no partial write for RGB binarization signal of the corresponding scan line is performed. In this way, the display state for only the portion that has been changed is altered.

The input signal is not limited to the RGB analog signal, but may be a multi-value digital signal, or further an image signal for any of color components other than R, G, B. Also, it is not limited to the color.

The signal for detection of a change point is not limited to a luminance signal, but may include a chromaticity signal, or is not limited to luminance and chromaticity.

The binarization technique for image is not limited thereto, but may be a pseudo-half tone process such as a dither method, or an average density preserve method as described in U.S. Pat. No. 5,130,819, or other binarization techniques.

The unit of the partial write is not limited to a scan line unit, but may be a block or pixel unit.

The configuration of the frame memory is not limited thereto, but may be of a plurality of line buffers or other configuration.

The subsampling technique for detection of the change point is not limited thereto, but may be a subsampling or filter process performed before the A/D conversion.

The display is not limited to the FLCD, but may be a display having a memory function as well.

As above described, with the provision of binarization means for the display and binarization means for the detection of interframe change, it is possible to provide the display with high definition as well as improving the precision for the detection of interframe change. Also, by converting the input signal into image signal such as luminance, it is possible to facilitate the extraction of a cursor, mainly composed of black and white, and reduce the memory capacity for detecting the interframe change, thereby attaining lower costs of the device. Also, owing to subsampling the image signal, it is also possible to attain the lower costs of the device, reduce the memory capacity for the detection of change point because of sampling less than the image size of display, eliminate the noise contained in the analog signal by the use of a low pass filter, resulting in the improvement in detection precision of interframe change.

As above-described, according to the above-described embodiments of the present invention, it is possible to display an excellent image by partially rewriting the display image.

The following embodiments 4 to 6 of the present invention provides a first quantization means for quantizing image information for the display, when displaying an image on the display having memory function, and a second quantization means for quantizing image information for the detection of an interframe change point to determine the partial rewrite area, wherein the precision of a partial rewrite area is improved by determining the area from the image obtained by said second quantization means.

Also, signal conversion means for converting an image signal input to the second quantization means is provided to effect conversion of the image signal, thereby improving the detection precision of a pointing mark such as a cursor as represented mainly by black and white.

Further, means is provided for sampling image signal input to the second quantization means in less than the number of pixels for the input image, thereby preventing any false detection of interframe change point due to noise.

(Fourth embodiment)

Figure 7:
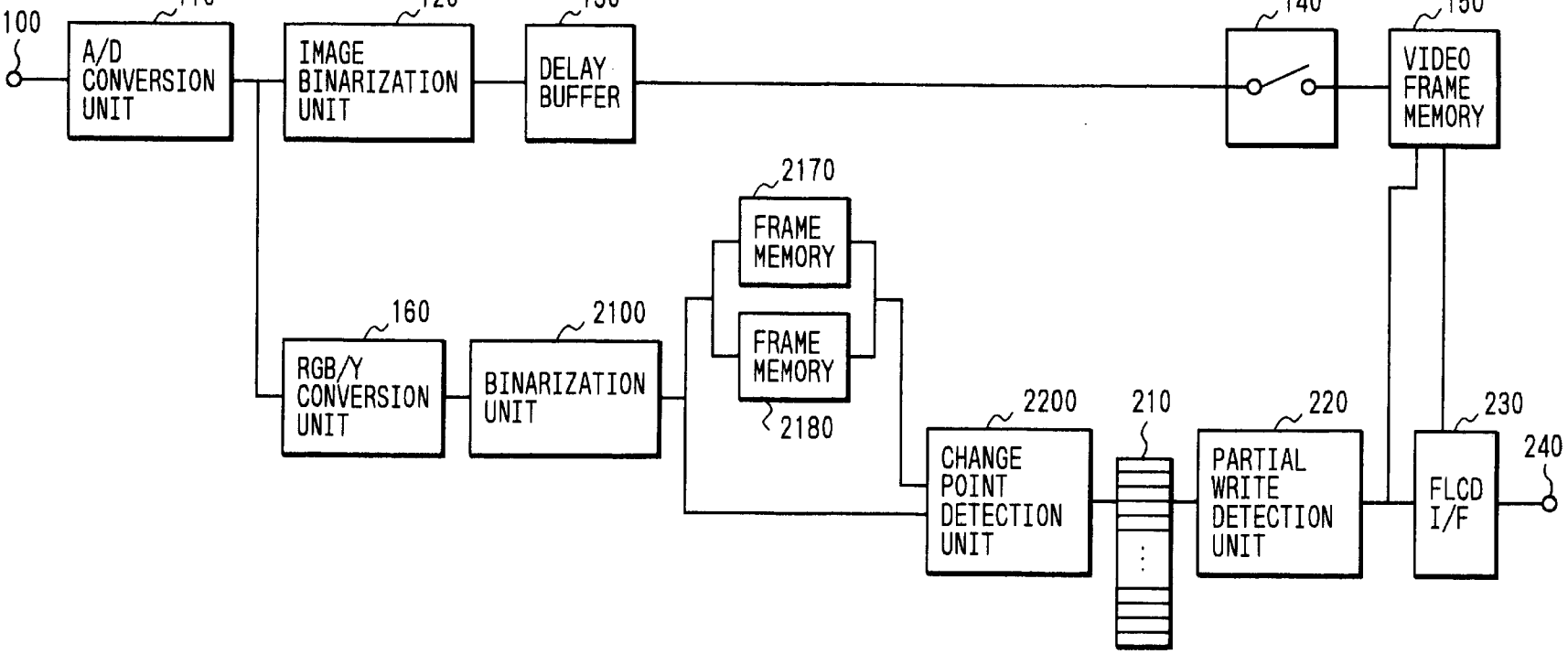
FIG. 7 is a block diagram showing the configuration of a display controlling apparatus according to the fourth embodiment.

FIG. 7 is a diagram showing the configuration of an image process unit in an image display system according to this embodiment.

In this embodiment, the input signal is supposed to be a non-interlace 60 Hz signal of component RGB. The quantization is performed by binarization.

FIG. 7 shows the details of the image process unit 20 as shown in FIG. 20. 100 is an input terminal of RGB analog output signal 11 from the computer 10, and 110 is an A/D conversion unit for A/D converting an RGB analog signal as input to create a multi-value (e.g., eight bits for each the RGB) digital RGB sig al. RGB analog signal is a 60 Hz non-interlace signal. 120 is an image binarization unit for converting a multi-value RGB digital signal into a signal, one bit for each RGB. Herein, the binarization technique for the image used herein is an error diffusion method suitable for the representation of a half tone. 130 is a delay buffer composed of a FIFO memory to effect synchronization. 140 is a switch which is turned on or off by partial write control signal. 150 is a frame memory for storing data, one bit for each RGB, of each pixel, and which is comprised of, for example, a two-port RAM. 160 is an RGB/Y conversion unit for generating multi-value Y signal which is a luminance signal from the multi-value digital RGB signal. 2100 is a binarization unit for binarizing multi-value Y signal. The binarization technique used herein is a simple binarization by comparison with a fixed threshold. 2170, 2180 are frame memories for storing binarized Y signal, and 2200 is a change point extraction unit for detecting the change point between frames by comparison between a binarized Y signal input and the binarized Y signal before one frame stored in the frame memory 2170 or 2180. 210 is a line flag memory for enabling a flag to be turned on or off for each scan line. 220 is a partial write detection unit for detecting whether or not the partial write is performed from the content of line flag memory 210 as well as controlling the partial write regarding the location of partial write. 230 is an FLCD interface for reading the content of video frame memory 150 for the output to the FLCD 30 via a terminal 240.

RGB analog signal of 60 Hz non-interlace from the computer 10 is input into the A/D conversion unit 110 via the terminal 100. Input multi-value RGB analog signal is A/D converted into multi-value RGB digital signal for the input to image binarization unit 120 and RGB/Y conversion unit 160. The image binarization unit 120 binarizes the input multi-value RGB signal for each color in succession by using the error diffusion method. Its result is stored in the delay buffer 130.

On the other hand, the multi-value RGB digital signal input into the RGB/Y conversion unit 160 is converted into a Y signal for each pixel in succession for the output to the binarization unit 2100. The conversion from the RGB signal into the Y signal is performed based on an expression:

$$Y=0.299\times R+0.587\times G+0.114\times \mathrm{B}$$

The Y signal input into the binarization unit 2100 is compared with a fixed threshold value for :he binarization. Binarized Y signal is written into the frame memory 2170 or 2180. The frame memories 2170 and 2180 are subjected to alternating operation of writing and reading in the unit of frame, that is, while one of them is written, the other is read.

The binarization Y signal is input into a change point extraction unit 2200. The change point extraction unit 2200 has a line buffer to create a 5×5 window for each pixel, compare it with binarized Y signal before one frame for each pixel, count the number of changed pixels, and compare it with the threshold, herein if the number of changed pixels is greater than the threshold, that point is extracted as a cha ge point. Before starting the process of scan lines, corresponding flags in the line flag memory 210 are reset. If any change point is extracted, the flag of the line flag memory 210 corresponding to the scan line of interest is set. If no change point exists within one can line, the flag set in the line flag memory 210, i any, is reset.

The partial write detection unit 22 monitors the flag status in the line flag memory 2 0, and if any flag is set, the partial write for th corresponding scan line is performed.

In performing the partial write, the switch 140 is turned on, and location information concerning the scan line for the partial write is transmitted to the video frame memory 150 and the FLCD interface unit 230. As a result, binarized RGB signal of scan line corresponding to the scan line at which change point is detected is read from the delay buffer 30, and written into the video frame memory 150. Further, the FLCD interface 230 reads RGB binarization signals of corresponding scan lines in the video frame memory 150 to change the display states of the corresponding scan lines of the FLCD 30 based on the scan line data of the FLCD 30.

If no flag is set in the line flag memory 210, the partial write detection unit 220 turns off the switch 140, wherein no partial write for RGB binarization signal of the corresponding scan line is performed. In this way, the display state for only the portion that has been changed is altered.

(Fifth embodiment)

Figure 8:
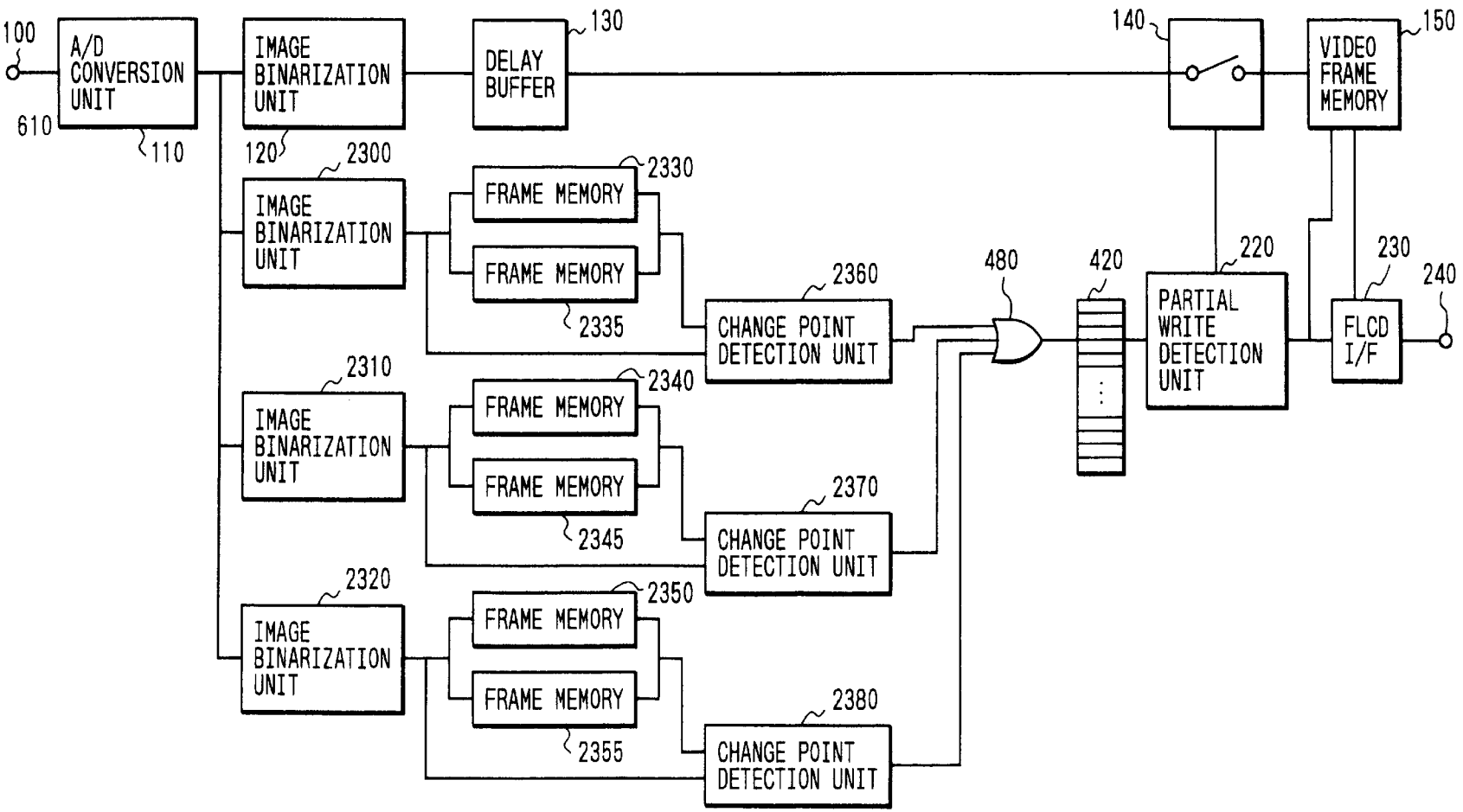
FIG. 8 is a block diagram showing the configuration of a display controlling apparatus according to the fifth embodiment.

FIG. 8 is a diagram showing the configuration of an image process unit in an image display system according to this embodiment. In FIG. 8, 1ike numerals refer to the parts having the same functions as in FIG. 7 of the embodiment 4. 2300, 310 and 2320 are binarization units for the image, and 2330, 2335, 2340, 2345, 2350 and 2355 are frame memories. 2360, 2370 and 2380 are change point extraction units for detecting the change point between frames by making a comparison between input binarized signal and binarized signal before one frame stored in the frame memory. 480 is an OR circuit.

RGB analog signal of 60 Hz non-interlace from the computer 10 is input into the A/D conversion unit 110 via the terminal 100. Input binarized RGB analog signal is A/D converted into multi-value RGB digit 1 signal for the input to image binarization unit 120, R multi-value signal being input into a binarization unit 2300, G multi-value signal into a binarization unit 2310, and B multi-value signal into a binarization unit 2320. The image binarization unit 120 binarizes input multi-value RGB signal for each color by using th error diffusion method. Its result is stored in he delay buffer 130.

Input R signal into the binarization unit 2300 is compared with a fixed threshold value for the binarization. Binarized R signal is written into a frame memory 2330 or 2335. The frame memories 2330 and 2335 are subjected to alternating operations of writing and reading in the unit of frame, that is, while one of them is written, the other is read. Binarized R signal is input into a change point extraction unit 2360. The change point extraction unit 2360 has line buffer to create a 5×5 window for each pixel, compare it with binarized R signal before one frame f r each pixel, count the number of changed pixels, and compare it with the threshold, wherein if the number of changed pixels is greater than the threshold, that point is extracted as a change point, and 1 is sent out. If no change point exists within one scan line, 0 is sent out. Likewise, the change point is detected for B binarized signal and G binarized signal.

The outputs from the change point extraction unit 2360 of R binarized signal, the change point extraction unit 2370 of G binarized signal and the change point extraction unit 2380 of B binarized signal are input into the OR circuit 480. The OR circuit 480 calculates the logical sum of these inputs for the output to the line flag memory 420.

Before starting the process of scan lines, corresponding flags in the line flag memory 420 are reset. If the output of OR circuit 480 is 1, the flag of the line flag memory 420 corresponding to the scan line of interest is set.

The partial write detection unit 220 monitors the flag status in the line flag memory 420, and if any flag is set, the partial write for the corresponding scan line is performed.

In performing the partial write, the switch 140 is turned on, and location information concerning the scan line for the partial write is transmitted to the video frame memory 150 and the FLCD interface unit 230. As a result, binarized RGB signal of scan line corresponding to the scan line at which change point is detected is read from the delay buffer 130, and written into the video frame memory 150. Further, the FLCD interface 230 reads RGB binarized signals of corresponding scan lines in the video frame memory 150 to change the display states of the corresponding scan lines of the FLCD 30 based on the scan line data of the FLCD 30.

If no flag is set in the line flag memory 420, the partial write detection unit 220 turns off the switch 140, wherein no partial write for RGB binarized signal of the corresponding scan line is performed. In this way, the display state for only the portion that has been changed is altered.

(Sixth embodiment)

Figure 9:
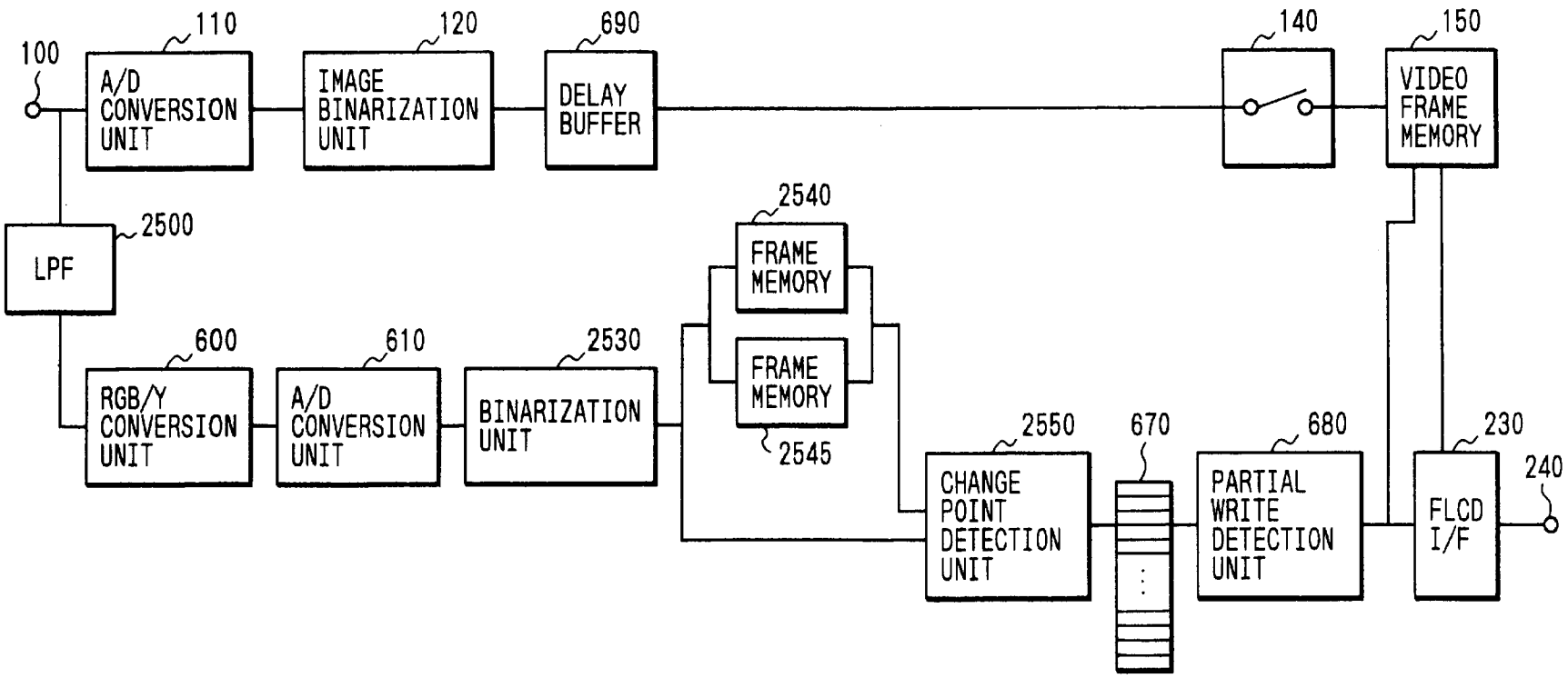
FIG. 9 is a block diagram showing the configuration of a display controlling apparatus according to the sixth embodiment.

FIG. 9 is a diagram showing the configuration of an image process unit in an image display system according to this embodiment. In FIG. 9, like numerals refer to the parts having the same functions as in FIG. 7 of the embodiment 4. 2500 is a low pass filter unit. 600 is an analog RGB/Y conversion unit for generating analog Y signal which is a luminance signal from analog RGB signal. 610 is an A/D conversion unit for A/D converting analog Y signal by subsampling the scan lines odd-numbered at half the frequency to create multi-value digital Y signal. 2530 is a binarization unit for the image. 2540, 2545 are frame memories having one-half the image size of display in vertical and horizontal directions. 2550 is a change point extraction unit for detecting the change point between frames by comparison between input binarized signal and binarized signal before one frame stored in the frame memory. 670 is a line flag memory the flags of which can be turned on or off for each scan line odd-numbered. 680 is a partial write detection unit for detecting whether or not the partial write is performed from the content of the line flag memory 670 to control the partial write regarding the location of partial write. 690 is a delay buffer.

RGB analog signal of 60 Hz non-interlace from the computer 10 is input into the A/D conversion unit 110 and the low pass filter unit 2500 via the terminal 100. Input multi-value RGB analog signal is A/D converted into multi-value RGB digital signal in the A/D conversion unit 110 for the input to image binarization unit 120. The image binarization unit 120 binarizes input multi-value RGB signal for each color in succession by using the error diffusion method. Its result is stored in the delay buffer 690.

On the other hand, the low pass filter 2500 causes each RGB signal to pass through the low pass filter to get the signal having half the frequency. The RGB signal having the frequency halved is input into analog RGB/Y conversion unit 600 for the conversion into analog Y signal, and then output to the A/D conversion unit 610. The A/D conversion unit 610 A/D converts analog Y signal by subsampling the scan lines odd-numbered at half the frequency to create multi-value digital Y signal for the input into the binarization unit 2530.

Input Y signal into the binarization unit 2530 is compared with a fixed threshold value for the binarization. Binarized Y signal is written into a frame memory 2540 or 2545. The frame memories 2540 and 2545 are subjected to alternating operations of writing and reading in the unit of frame, that is, while one of them is written, the other is read. The binarized Y signal is input into a change point extraction unit 2550. The change point extraction unit 2550 has a line buffer to create a 3×3 window for each pixel, compare it with binarized Y signal before one frame for each pixel, add changed pixels by weighting as shown in FIG. 5, compare its sum with a threshold, wherein if the sum is greater than the threshold, that point is extracted as a change point, and the flag in the line flag memory 560 corresponding to the scan line of interest is set. Before starting the process of scan lines, corresponding flags in the line flag memory 560 are reset. If no change point exists within one scan line, the flag in the line flag memory 560 for the scan line of interest remains reset.

The partial write detection unit 680 monitors the flag status in the line flag memory 670, and if any flag is set, the partial write for the corresponding scan line is performed.

In performing the partial write, the switch 140 is turned on, and location information concerning the scan line for the partial write is transmitted to the video frame memory 150 and the FLCD interface unit 220. If the partial write is not performed at the previous scan line odd-numbered, the partial write detection unit 680 reads data of the scan line of interest odd-numbered and data of the scan lines even-numbered before and after that scan line of interest from the delay buffer 690. The location information, including the location of the scan line of interest odd-numbered and the locations of the scan lines even-numbered before and after that scan line of interest, is transmitted to and written into the video frame memory 150. At the same time, location information is also transmitted to the FLCD interface 230, which reads RGB binarized signals of corresponding scan lines in the video frame memory 150 to change the display states of the corresponding scan lines of the FLCD 30 based on the scan line data of the FLCD 30.

If no flag is set in the line flag memory 560, the partial write detection unit 570 turns off the switch 130, wherein no partial write for RGB binarized signal of the corresponding scan line is performed. In this way, the display state for only the portion that has been changed is altered.

The input signal is not limited to the RGB analog signal, but may be a multi-value digital signal, or further an image signal for any of color components other than R, G, B. Also, it is not limited to the color.

The signal for detection of a change point is not limited thereto, but may include a chromaticity signal, and is not also limited to luminance and chromaticity.

The binarization technique for image is not limited thereto, but may be other binarization methods such as a dither method or an average density preserve method.

The binarization technique of image for the detection of interframe change is not limited thereto, but may be other binarization techniques such as a dither method.

The extraction method of a change point is not limited thereto, but it is conceived that the image may be divided into blocks, or the change in a unit of a pixel may be utilized.

The unit of the partial write is not limited to a scan line unit, but may be a block or pixel unit.

The configuration of the frame memory is not limited thereto, but may be of a plurality of line buffers or other configuration.

The subsampling technique for the detection of a change point is not limited thereto, but may be a subsampling or filter process such as projection performed before the A/D conversion.

The technique for the display is not limited to the FLCD, but may be a display having a memory function.

Quantization has been described in binarization, but it is conceived that a greater degree of quantization, for example, ternary based on two thresholds, may be used.

As above described, with the provision of binarization means for the display and binarization means for the detection of interframe change, it is possible to provide the display with high definition as well as improving the precision for the detection of interframe change. Also, by converting the input signal into an image signal such as luminance, it is possible to facilitate the extraction of a cursor, mainly composed of black and white, and reduce the memory capacity for the detection of interframe change, thereby attaining lower costs of the device. Also, owing to subsampling the image signal, it is possible to attain the lower costs of the device, reduce the memory capacity for the detection of a change point because of sampling less than the image size for display, eliminate the noise contained in the analog signal by the use of a low pass filter, resulting in the improvement in detection precision of interframe change.

As above described, according to the above embodiments 4 to 6 of the present invention, it is possible to display an excellent image by partially rewriting the display image.

The following embodiments 7 and 8 of the present invention provide quantization means for quantizing image information for the display onto a display having a memory function, and interframe change detection means for detecting the interframe change point from a quantized image by said quantization means, wherein the detection result for the interframe change is used to determine the partial rewrite area, when displaying the image quantized by said quantization means.

(Seventh embodiment)

Figure 10:
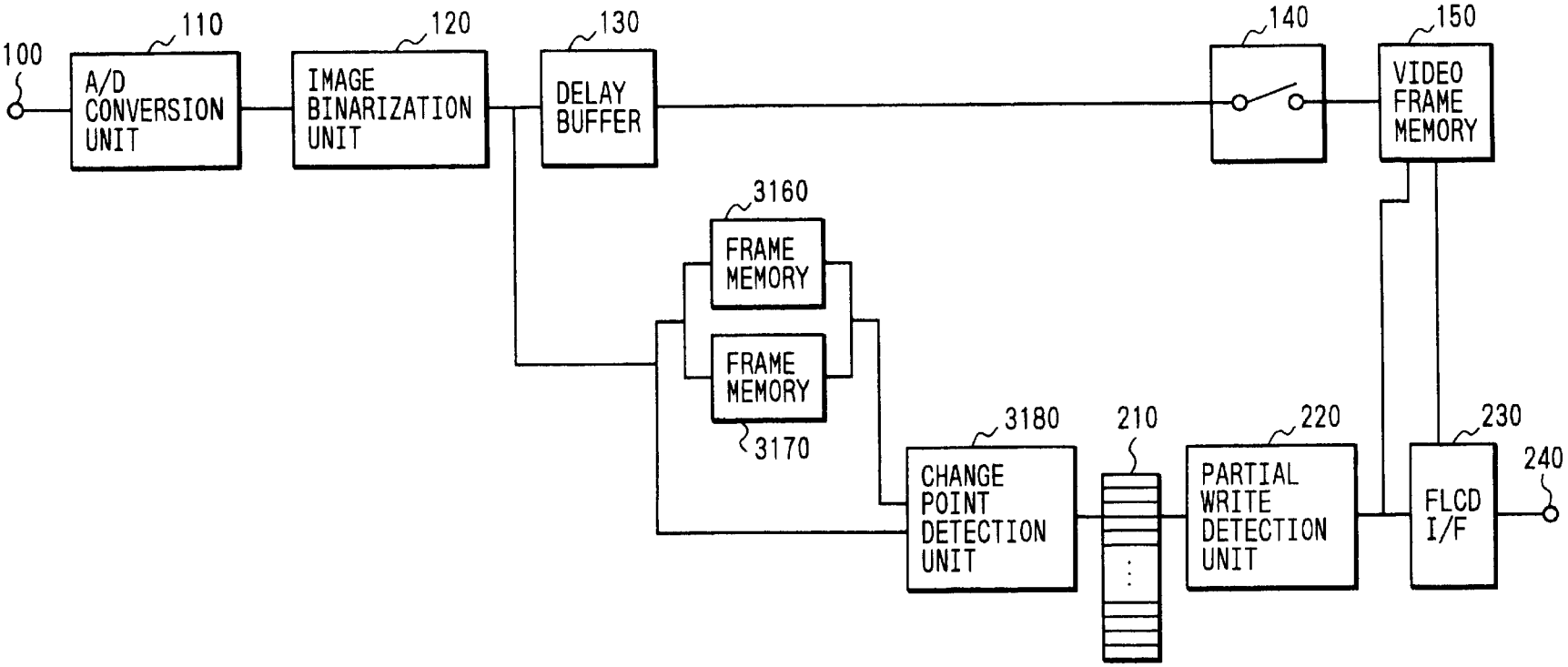
FIG. 10 is a block diagram showing the configuration of a display controlling apparatus according to the seventh embodiment.

FIG. 10 is a diagram showing the configuration of an image process unit in an image display system according to this embodiment.

Figure 2:
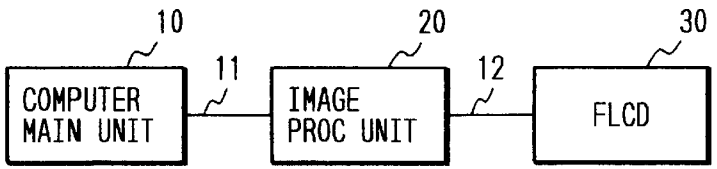
FIG. 2 is an overall diagram of an image display system to which the present invention is applied.

FIG. 10 shows the details of the image process unit 20 as shown in FIG. 2. 100 is an input terminal of black-and-white analog output signal from the computer 10, and 110 is an A/D conversion unit for A/D converting a black-and-white analog signal as input to create multi-value digital black-and-white signal. Black-and-white analog signal is a 60 Hz non-interlace signal. 120 is an image binarization unit for converting multi-value black-and-white digital signal into signal, one bit for each of black and white. For the explanation, binarization technique for the image used herein is a dither method. 130 is a delay buffer composed of a FIFO memory to effect synchronization. 140 is a switch which is turned on or off by a control signal. 150 is a frame memory for storing data, one bit for each of black and white, of each pixel, and which is comprised of, for example, a two-port RAM.

3160, 3170 are frame memories for storing binarized black-and-white signal, and 3180 is a change point extraction unit for detecting the change point between frames by comparison between input binarized black-and-white data and binarized black-and-white image data before one frame stored in the frame memory 3160 or 3170. 210 is a line flag memory for enabling a flag to be turned on or off for each scan line. 220 is a partial write detection unit for detecting whether or not the partial write is performed from the content of line flag memory 210 as well as controlling the partial write regarding the location of partial write. 230 is an FLCD interface for reading the content of video frame memory 150 for the output to the FLCD 30 via terminal 240.

Black-and-white analog signal of 60 Hz non-interlace from the computer 10 is input into the A/D conversion unit 110 via the terminal 100. The input black-and-white analog signal is A/D converted into multi-value black-and-white digital signal for the input to image binarization unit 120. The image binarization unit 120 binarizes input multi-value black-and-white signal in succession by using the dither method. Its result is stored in the delay buffer 130, written in the frame memory 3160 or 3170, and input to the change point detection unit 3180. The frame memories 3160 and 3170 are subjected to alternating operations of writing and reading in the unit of frame, that is, while one of them is written, the other is read.

A binarized black-and-white signal is input into a change point extraction unit 3180. The change point extraction unit 3180 has a line buffer to create a 3×3 window for each pixel, compare it with binarized black-and-white signal before one frame for each pixel, count the number of changed pixels, and compare it with the threshold, wherein if the number of changed pixels is greater than the threshold, that point is extracted as a change point.

Figure 11:
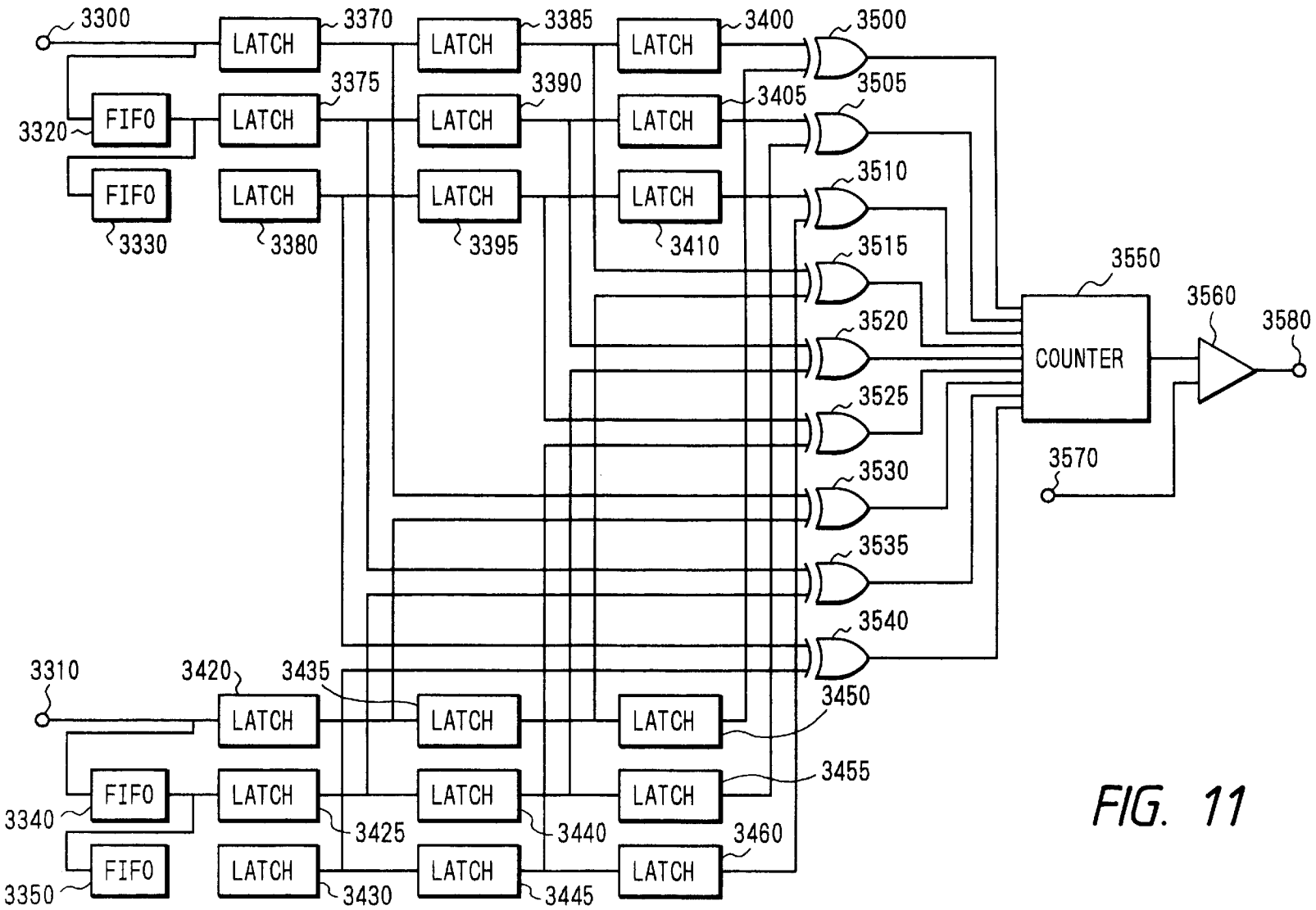
FIG. 11 is a block diagram showing the configuration of a change point detection unit according to the seventh embodiment.

FIG. 11 shows a detail block diagram of change point detection unit 3180.

3300 is a terminal for the input of black-and-white binarized image data from the image binarization unit 120. 3310 is a terminal for the input of black-and-white binarized image data before one frame from a frame memory 3160 or 3170. 3320, 3330, 3340 and 3350 are FIFO memories of one line. 3370 to 3460 are latches of one bit. Each of FIFO memories and latches operates in synchronization with the clock of a pixel. 3500 to 3540 are exclusive OR circuits with two inputs and one output, wherein if two inputs are different, 1 is output. 3550 is a counter for counting the number of from input data for each pixel clock. 3560 is a comparator. 3570 is a terminal for the input of threshold of the comparator 3560 from the external. 3580 is a terminal for the output from the comparator 3560 to the external, and which is connected to the line flag memory 210.

It is now supposed that the image binarization unit 120 binarizes the m-th pixel in the n-th scan line, and black-and-white binarized image data is input through the terminal 3300. The latch 3370 has latched binarized data at the m-th pixel in the n-th scan line. At this point, the latch 3385 has latched binarized data at the (m−1)-th pixel in the n-th scan line, and the latch 3400 has latched binarized data at the (m−2)-th pixel in the n-th scan line. Binarized data at the m-th pixel in the n-th scan line is also input into the FIFO memory 3320 to provide a delay of one line. The latches 3375, 3390 and 3405 have latched binarized data at the m-th pixel, the (m−1)-th pixel, and the (m−2)-th pixel, respectively, in the (n−1)-th scan line. Binarized data at the m-th pixel in the (n−1)-th scan line is also input into the FIFO memory 3330 to provide a delay of one line. The latches 3380, 3395 and 3410 have latched binarized data at the m-th pixel, the (m−1)-th pixel, and the (m−2)-th pixel, respectively, in the (n−2)-th scan line.

At the same time, black-and-white binarized image data at the m-th pixel in the n-th scan line before one frame is input from the frame memory 3160 or 3170 via the terminal 3310. FIFO memories 3340, 3350 and latches 3420 to 3460 operate in the same way.

At this point, a window of 3×3 around the (m−1)-th pixel in the (n−2)-th scan line of the frame input to the latches 3370 to 3410 and a window of 3×3 around the (m−1)-th pixel in the (n−1)-th scan line of the previous frame input to the latches 3420 to 3460 are formed. The exclusive OR circuits 3500 to 3540 judge whether or not these pixel data are equal for the output to a counter 3550. The exclusive OR circuit 3500 has the (m−2)-th pixel in the n-th scan line for the input frame and the (m−2)-th pixel in the n-th scan line for the previous frame.

The counter 3550 counts the number of is, that is, the number of changed pixels, in the exclusive OR circuits 3500 to 3540. To facilitate the explanation, it is supposed that the value 3 is input from the terminal 3570 at all times. The comparator 3560 compares the counted result of counter 3550 with this threshold, and if the result is greater than the threshold, 1 is output from the terminal 580, or otherwise, 0 is output.

Before starting the process of scan lines, corresponding flags in the line flag memory 1210 are reset.

If any change point is extracted in the process of scan lines, that is, 1 is output from the terminal 3580, the flag of the line flag memory 210 corresponding to the scan line of interest is set. The image binarization unit 120 binarizes the m-th pixel in the n-th scan line, or the (n−1)-th scan line if black-and-white binarization image data is input.

The partial write detection unit 220 monitors the flag status in the line flag memory 210, and if any flag is set, the partial write for the corresponding scan line is performed.

In performing the partial write, the switch 140 is turned on, and location information concerning the scan line for the partial write is transmitted to the video frame memory 150 and the FLCD interface unit 210. As a result, a binarized black-and-white signal of a scan line corresponding to the scan line at which change point is detected is read from the delay buffer 130, and written into the video frame memory 150. Further, the FLCD interface 230 reads a black-and-white binarized signal of corresponding scan lines in the video frame memory 150 to change the display states of the corresponding scan lines of the FLCD 30 based on the scan line data of the FLCD 30.

If no flag is set in the line flag memory 210, the partial write detection unit 220 turns off the switch 140, wherein no partial write for black-and-white binarization signal of the corresponding scan line is performed. In this way, the display state for only the portion that has been changed is altered.

(Eighth embodiment)

Figure 12:
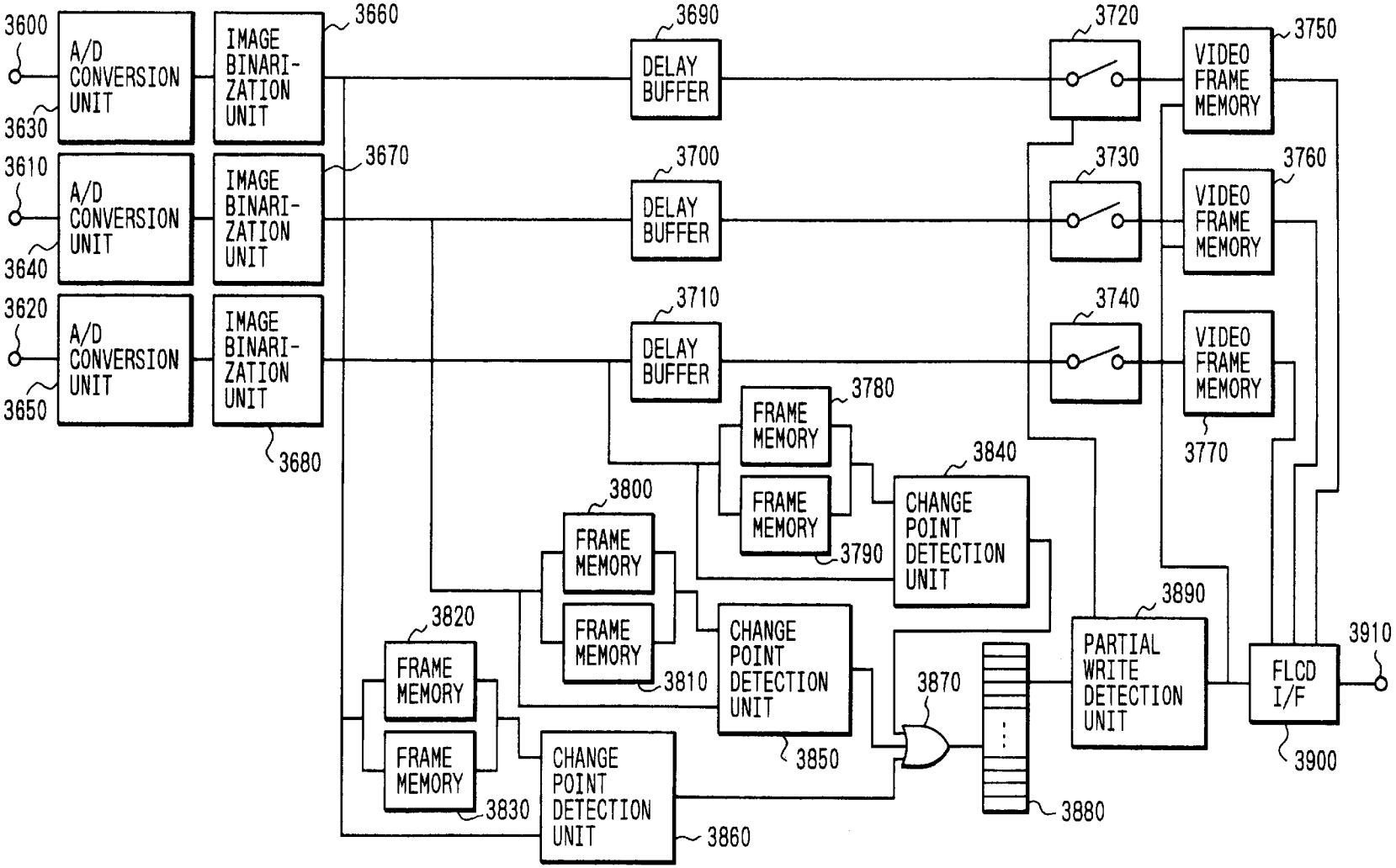
FIG. 12 is a block diagram showing the configuration of a display controlling apparatus according to the eighth embodiment.

FIG. 12 is a diagram showing the configuration of an image process unit in an image display system according to this embodiment.

In this embodiment, the signal is an RGB color non-interlace 60 Hz signal.

FIG. 12 shows the details of the image process unit 20 as shown in FIG. 2. 3600, 3610 and 3620 are terminals for the input of color red analog output signal, color green analog output signal and color blue analog output signal, respectively, from the computer 10. 3630, 3540 and 3650 are A/D conversion units for A/D converting an input analog signal to create a multi-value digital signal. 3660, 3670 and 3680 are image binarization units, for converting red multi-value digital signal, green multi-value digital signal and blue multi-value digital signal, respectively, into a one-bit signal. For the explanation, the binarization technique for the image used herein is a dither method. 3690, 3700 and 3710 are delay buffers, respectively, composed of a FIFO memory to effect synchronization. 3720, 3730 and 3740 are switches which are turned on or off by a control signal.

3750 is a frame memory for storing red one-bit data for each pixel, 3760 is a frame memory for storing green one-bit data for each pixel, and 3770 is a frame memory for storing blue one-bit data for each pixel, all of which are comprised of, for example, two-port RAM.

3780, 3790, 3800, 3810, 3820 and 3830 are frame memories for storing binarized data for each color. 3840 is a change point detection unit for detecting the change point between frames by comparison between input blue binarized image data and blue binarized image data before one frame stored in the frame memory 3780 or 3790. Likewise, 3850 is a change point detection unit for detecting the change point is green binarized image data by comparison between frames, and 3860 is a change point detection unit for detecting the change point in red binarized image data by comparison between frames. 3870 is an OR circuit for ORing three inputs. 3880 is a line flag memory for enabling a flag to be turned on or off for each scan line. 3890 is a partial write detection unit for detecting whether or not the partial write is performed from the content of line flag memory 3880 as well as controlling the partial write regarding the location of partial write. 3900 is an FLCD interface for reading the respective contents of video frame memories 3750, 3760, 3770 synchronously for the output to the FLCD 30 via terminal 220.

Red (R) analog signal, green (G) analog signal and blue (B) analog signal of 60 Hz non-interlace from the computer 10 are input into A/D conversion units 3660, 3670, 3680, via terminals 3600, 3610, 3620, respectively. Input multi-value RGB analog signal is A/D converted into multi-value RGB digital signal for the input to respective image binarization unit 3690, 3700, 3710 for each color.

Figure 13:
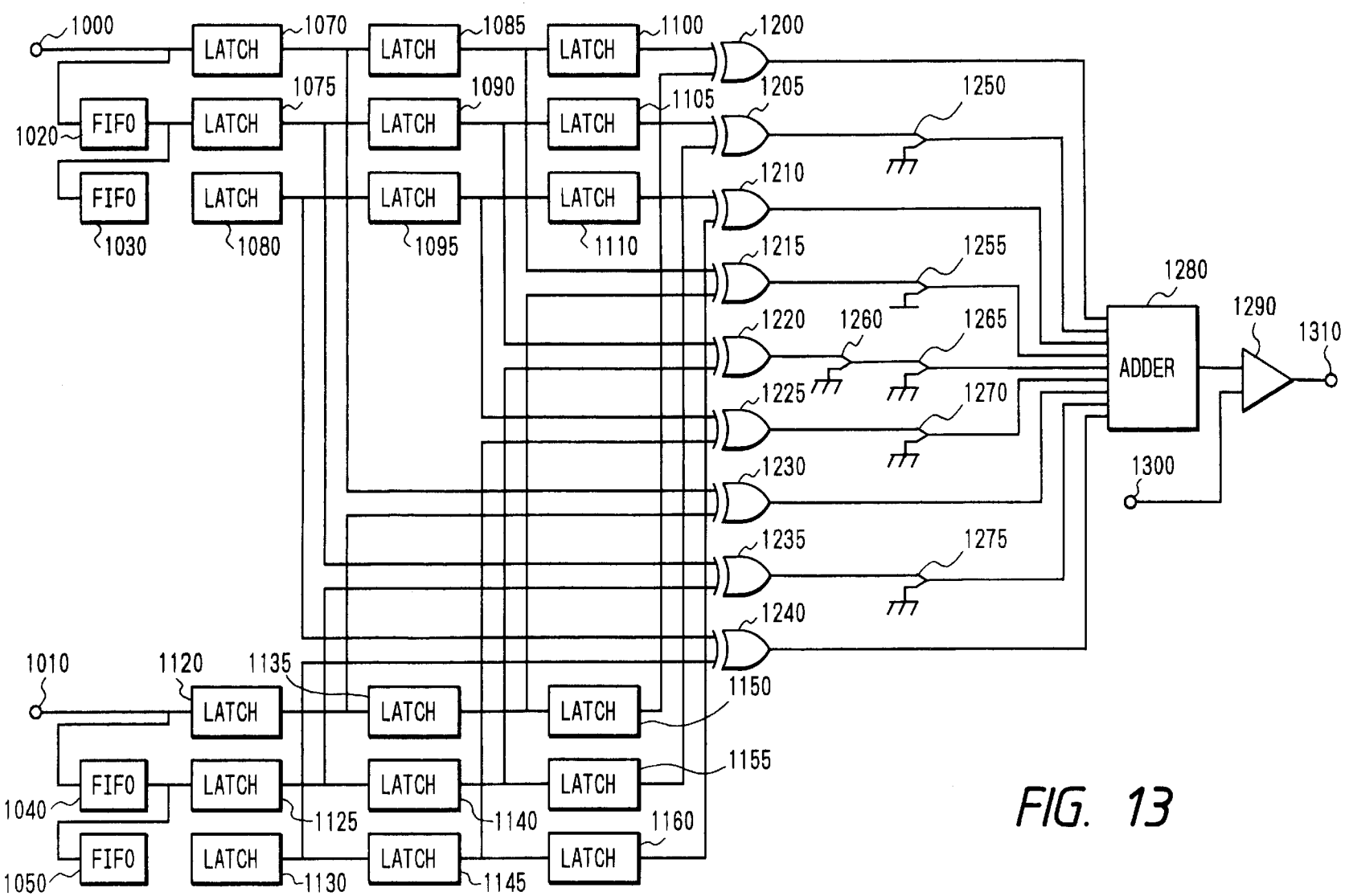
FIG. 13 is a block diagram showing the configuration of a change point detection unit according to the eighth embodiment.

The image binarization unit 120 binarizes input multi-value RGB signal in succession for each color by using the dither method. Its result is stored in a delay buffer 3690, 3700, 3710 for each color. The frame memories 3820 and 3830 are subjected to alternating operations of writing and reading in the unit of frame, that is, while one of them is written, the other is read. Binarized R signal is input into a change point detection unit 3860. The details of the change point detection unit 3860 are shown in FIG. 13.

1000 is a terminal for the input of red binarized image data from red image binarization unit 2660. 1010 is a terminal for the input of red binarized image data before one frame from frame memory 3820 or 3830. 1020, 1030, 1040 and 1050 are FIFO memories of one line. 1070 to 1160 are latches of one bit. FIFO memories and latches operate in synchronization with the clock of a pixel. 1200 to 1240 are exclusive OR circuits with two inputs and one output, wherein if two inputs are different, 1 is output.

1250 to 1275 are doublers for doubling input line data as the upper level by adding zero of 1 bit to the lower level. 1280 is an adder for adding input data for each pixel clock. 1290 is a comparator. 1300 is a terminal for the input of threshold of comparator 1290 from the external. 1310 is a terminal for the output of the result of comparator 1300 to the external, which is connected to the OR circuit 870.

It is now supposed that the image binarization unit 3660 binarizes the m-th pixel in the n-th scan line, and black-and-white binarized image data is input from the terminal 3300. The latch 1070 has latched binarized data at the m-th pixel in the n-th scan line. At this point, the latch 1085 has latched binarized data at the (m−1)-th pixel in the n-th scan line, and the latch 1100 has latched binarized data at the (m−2)-th pixel in the n-th scan line. Binarized data at the m-th pixel in the n-th scan line is also input into the FIFO memory 1020 to provide a delay of one line. The latches 1075, 1090 and 1105 have latched binarized data at the m-th pixel, the (m−1)-th pixel, and the (m−2)-th pixel, respectively, in the (n−1)-th scan line. Binarized data at the m-th pixel in the (n−1)-th scan line is also input into the FIFO memory 1030 to provide a delay of one line. The latches 1080, 1095 and 1110 have latched binarized data at the m-th pixel, the (m−1)-th pixel, and the (m−2)-th pixel, respectively, in the (n−2)-th scan line.

At the same time, black-and-white binarized image data at the m-th pixel in the n-th scan line before one frame is input from the frame memory 3820 or 3830 via the terminal 1010. FIFO memories 1040, 1050 and latches 1120 to 1160 operate in the same way.

At this point, a window of 3×3 around the (m−1)-th pixel in the (n−1)-th scan line of the frame input to the latches 1070 to 1110 and a window of 3×3 around the (m−1)-th pixel in the (n−1)-th scan line of the previous frame input to the latches 1120 to 1160 are formed. The exclusive OR circuits 1200 to 1240 judge whether or not these pixel data are equal.

Herein, 3×3 window is weighted as shown in FIG. 5. The exclusive OR circuits 1200, 1210, 1230, 1240 output the result to the adder 1280. The exclusive OR circuits 1205, 1215, 1225, 1235 are connected to the doublers 1250, 1255, 1270, 1275, respectively, to double the value for the output to the adder 1280. The output of the exclusive OR circuit 1220 is connected to doublers 1260, 1265 to quadruple the value for the output to the adder 1280. To facilitate the explanation, it is supposed that the value 6 is input at all times from the terminal 1300. A comparator 1290 compares the result of adder 1280 with the threshold, wherein if it is greater than the threshold, 1 is output from the terminal 1310, or otherwise, 0 is output.

Likewise, for the blue and green binarized signals, the change point is detected in the change point detection units 3850, 3840 of the same configuration, respectively.

The outputs of change point detection unit 3860 for red binarized signal, change point detection unit 3850 for green binarized signal and change point detection unit 3840 for blue binarized signal are input into OR circuit 3870. The OR circuit 3870 calculates the logical sum of these inputs for the output to line flag memory 3880.

Before starting the process of scan lines, corresponding flags in the line flag memory 3880 are reset. If the output of the OR circuit 3870 is equal to 1, the flag corresponding to the scan line or interest in the line flag memory 3880 is set.

The partial write detection unit 3890 monitors the flag status in the line flag memory 3880, wherein if any flag is set, the partial write for the corresponding scan line is performed.

In performing the partial write, switch 3720, 3730, 3740 for each color is turned on, and location information concerning the scan line for the partial write is transmitted to the video frame memory 3750, 3760, 3770 for each color and the FLCD interface unit 3900. As a result, binarized RGB signal of a scan line corresponding to the scan line at which change point is detected is read from the delay buffer 3690, 3700, 3710 for each color, and written into the video frame memory 3750, 3760, 3770 for each color. Further, the FLCD interface 3900 reads RGB binarized signals of corresponding scan lines in the video frame memory 3750, 3760, 3770 for each color to change the display states of the corresponding scan lines of the FLCD 30 based on the scan line data of the FLCD 30.

If no flag is set in the line flag memory 3870, the partial write detection unit 3890 turns off the switch 3720, 3730, 3740 for each color, wherein no partial write for RGB binarized signal of the corresponding scan line is performed. In this way, the display state for only the portion that has been changed is altered.

The input signal is not limited thereto, but may be a multi-value digital signal, or further other image signals.

The binarization technique for image is not limited thereto, but may be other binarization methods such as an average density preserve method.

The binarization technique of image for the detection of interframe change is not limited thereto, but may be other binarization techniques.

The detection method of change point is not limited thereto, but it is conceived that the image may be divided into blocks, or the change in a unit of a pixel may be utilized. Also, weighting is not limited thereto.

The unit of the partial write is not limited to a scan line unit, but may be a block or pixel unit.

The configuration of the frame memory is not limited thereto, but may be of a plurality of line buffers or other configuration.

The subsampling technique for detection of change point is not limited thereto, but may be a subsampling or filter process such as projection performed after the A/D conversion.

Means for discriminating the update of image data is not limited thereto, but may involve a memory write enable signal or may be another method.

The technique for the display is not limited to the FLCD, but may be a display having a memory function.

Quantization has been described in binarization, but it is conceived that a greater degree of quantization, for example, ternary based on two thresholds, may be used.

As above described, for the display onto a display having memory function, there are provided quantization means for quantizing image information, change detection area setting means for setting the area consisting of one or more pixels from the image quantized by said quantization means, and interframe change detection means for detecting the change point between frames, it is possible to provide the display with high definition as well as improving the detection precision of interframe change by determining the area for detection of change point between frames.

Also, by referring to a plurality of pixels subsampled around an image signal, it is possible to eliminate the noise applied by the analog signal, and improve the detection precision of change point between frames.

(Ninth embodiment)

Figure 14:
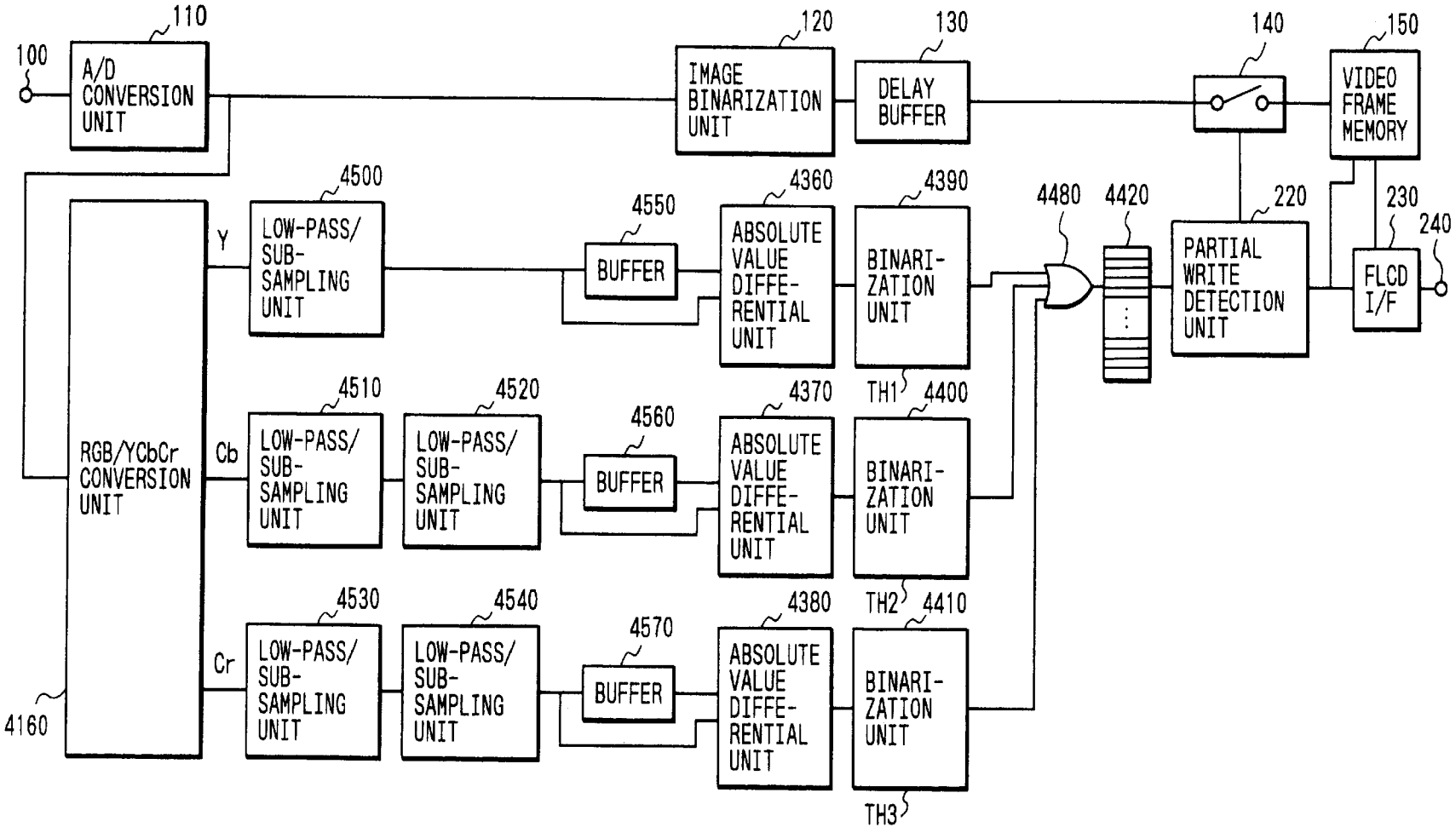
FIG. 14 is a block diagram showing the configuration of a display controlling apparatus according to the ninth embodiment.

A preferred embodiment will be described below. FIG. 14 is a diagram showing the configuration of an image process unit in an image display system according to this embodiment.

In this embodiment, the signal is a component RGB non-interlace 60 Hz signal.

FIG. 14 shows the details of the image process unit 20 as shown in FIG. 2. 100 is an input terminal of RGB analog output signal from the computer 10, and 110 is an A/D conversion unit for A/D converting input RGB analog signal to create multi-value digital RGB signal. RGB analog signal is a 60 Hz non-interlace signal. 120 is an image binarization unit for converting multi-value RGB digital signal into a signal, one bit for each RGB. Herein, the binarization technique for the image is a pseudo-half tone process suitable for representing the half tone, including, for example, an error diffusion method. 130 is a delay buffer composed of a FIFO memory to effect synchronization. 140 is a switch which is turned on or off by a control signal. 150 is a frame memory for storing data, one bit for each RGB, of each pixel, and which is comprised of, for example, a two-port RAM. 4160 is an RGB/YCbCr conversion unit for converting a multi-value digital signal RGB into a luminance Y signal and chrominance Cb, Cr signals. 4500 to 4540 are low pass/subsampling units for performing the the low filter process as well as the subsampling of picking up the image signal. 4550, 4560, 4570 are buffers for temporarily storing Y, Cb, Cr signals after the low pass/subsampling process for each frame, respectively. 4360, 4370, 4380 are absolute value differential units for calculating the absolute value differential in pixel value at the same location between stored image signal before one frame and the next image signal. 4390, 4400, 4410 are binarization units for binarizing the absolute value differential obtained by 4550, 4560, 4570 at threshold TH1, TH2, TH3, respectively, wherein if the pixel is 1, the pixel is determined to have been changed. These binarized signals are ORed in OR circuit 4480, wherein if the line with "1" exists, the flag is set in the line flag memory 4420.

4420 is a line flag memory for enabling a flag to be turned on or off for each scan line. 220 is a partial write detection unit for detecting whether or not the partial write is performed from the content of line flag memory 420 as well as controlling the partial write regarding the location of partial write. 230 is an FLCD interface for reading the content of video frame memory 150 for the output to the FLCD 30 via terminal 240.

RGB analog signal of 60 Hz non-interlace from the computer 10 is input into the A/D conversion unit 110 via the terminal 100. Input multi-value RGB analog signal is A/D converted into multi-value RGB digital signal for the input to image binarization unit 120 and RGB/Y conversion unit 4160. The image binarization unit 120 binarizes input multi-value RGB signal in succession for each color by using the error diffusion method. Its result is stored in the delay buffer 130.

On the other hand, multi-value RGB digital signal input into the RGB/Y conversion unit 4160 is converted into Y, Cb, Cr signals in succession for each pixel. The conversion from RGB signal to YCbCr signals is performed by the following expressions:

$$Y=0.299\times R+0.587\times G+0.114\times B$$

$$Cb=(B-Y)\times 0.564+128$$

$$Cr=(R-Y)\times 0.713+128$$

Figures 15, 16:
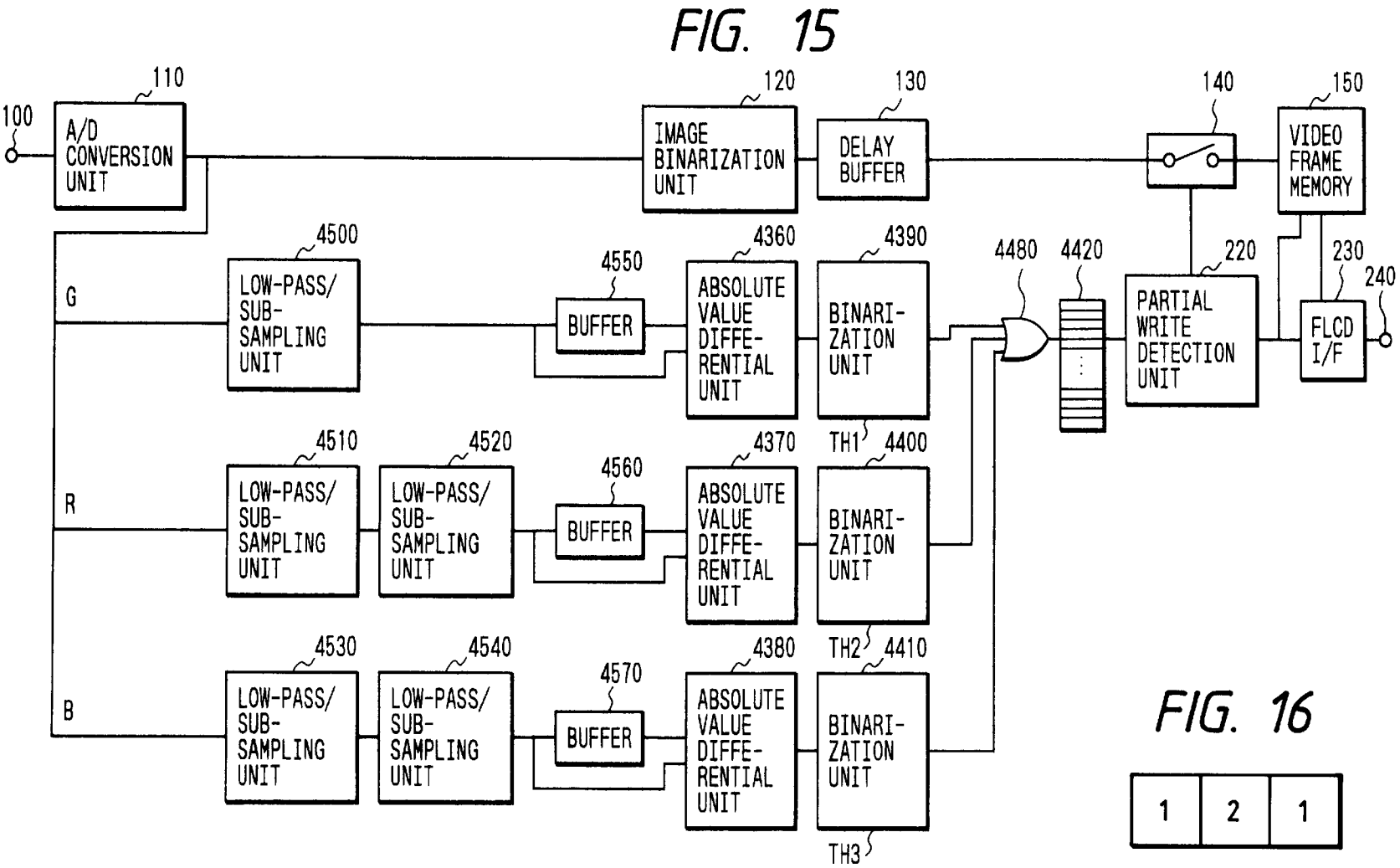
FIG. 15 is a block diagram showing the configuration of a display controlling apparatus according to the tenth embodiment.
FIG. 16 is a diagram showing a low pass filter useful for smoothing according to the tenth embodiment.

Y signal is passed through the low pass filter process in the low pass/subsampling unit, and subsampled for the pixel values odd-numbered at half frequency. FIG. 16 shows an example of the low pass filter. For all the pixels, convolution operation is performed by weighting pixel of concern with 2 and left and right pixels with 1. Thereafter, odd-numbered pixels are subsampled. Buffer 4550 stores Y data having one-half the number of pixels in each line for one screen. For Cb, Cr signals, the same process is performed, except that this low pass/subsampling process is repeated twice at 4510, 4520 and 4530, 4540. That is, for the Cb, Cr signals, data having one-quarter the number of pixels for each line is stored in the buffers 4560, 4570 for one screen, respectively. The detection of changed pixels is performed separately for each of Y, Cb, Cr signals in the absolute value differential unit 4360, 4370, 4380 and the binarization unit 4390, 4400, 4410, but the sampling interval is different between Y and CbCr. That is, since it is believed that Y signal contains the most important information in the respects of variation and movement among the color image components, it has a two times greater detection precision in terms of variation than CbCr. To increase the detection precision, it is desirable not to perform subsampling if possible, but because the buffer capacity is increased by taking differential from the previous frame, ½ subsampling for Y and twice ½ or ¼ subsampling for CbCr are made in this embodiment. For the CbCr signals, the portion having less variation in luminance with the color changed is mainly detected. For the Y signal, pixel values subsampled with the previous frame stored in the buffer 4550 are stored by one frame. The absolute value of the differential in pixel value between the current frame and the previous frame is calculated sequentially in the absolute value differential unit 4360, and compared with a fixed threshold TH1 for the binarization in the binarization unit 4390. If the absolute value of the differential is greater than the threshold TH1, "1" is output, or otherwise, "0" is output. For Cb, Cr signals, the same process is performed, wherein binarization is performed using the thresholds TH2, TH3 in the binarization units 4400, 4410.

It suffices that the thresholds TH1 to TH3 are greater than the analog noise. There are various ways for determining the thresholds TH1 to TH3. For example, an analog signal having a single luminance (herein, 128 is supposed), output beforehand, is input via the terminal 100, converted into digital data in the A/D conversion unit 110, input to the RGB/YCbCr conversion unit 4160 for the conversion into the YCbCr signal, and written into the buffers 4550, 4560,

4570. It is also possible that the absolute value differential units 4360, 4370, 4380 calculate the absolute value differential from the fixed value (herein, 128), but not the input from the RGB/YCbCr conversion unit 4160, with its maximum value defined as the threshold TH.

If binarized absolute value differential signal is equal to 1, that signal is extracted as a change point. The logical sum for the change point of YCbCr is taken in the OR circuit 4480, and if there is any change, the flat "1" is set in the line flag memory 4420. The line flag memory 4420 resets the flag, before starting the process of scan lines for each frame. If any one change point is extracted, the flag for that line is set to "1". If no change point exists within one scan line, the corresponding flag in the line flag memory is set to "0".

The partial write detection unit 220 monitors the flag status in the line flag memory 4420, and if any flag is set, the partial write for the corresponding scan line is performed.

In performing the partial write, the switch 140 is turned on, and location information concerning the scan line for the partial write is transmitted to the video frame memory 150 and the FLCD interface unit 230. As a result, binarized RGB signal of scan line corresponding to the scan line at which change point is detected is read from the delay buffer 130, and written into the video frame memory 150. Further, the FLCD interface 230 reads RGB binarized signals of corresponding scan lines in the video frame memory 150 to change the display states of the corresponding scan lines of the FLCD 30 based on the scan line data of the FLCD 30.

If no flag is set in the line flag memory 4420, the partial write detection unit 220 turns off the switch 140, wherein no partial write for RGB binarization signal of the corresponding scan line is performed. In this way, the display state for only the portion that has been changed is altered.

(Tenth embodiment)

FIG. 15 is a diagram showing the configuration of an image process unit in an image display system according to this embodiment. In FIG. 15, like numerals refer to the parts having the same functions as in FIG. 14 of the embodiment 9. FIG. 15 is an embodiment wherein the signal for the detection of change point is an RGB signal itself. The RGB signal digitized by the A/D conversion unit 110 is directly input into the low pass subsampling units 4510, 4500, 4530. Herein, since it is believed that the G signal contains the most important component for detecting the variation and movement, the subsampling rate is ½ for R and ¼ for B. By doing so, it is possible to reduce the buffer memory, like Y, CbCr, as well as detecting the change point in high precision.

While in this embodiment the detection of change point was performed for the luminance and chrominance signals Y, Cb, Cr with the luminance signal Y weighted, it will be appreciated that it can be performed using the luminance and chrominance signals of LUV, L*a*b*, YIQ in the same way.

While the subsampling was ½ for each scan line, it will be appreciated that the sampling may be 2:1 in horizontal and vertical directions for two-dimensional low pass filter, as shown in FIG. 5.

As above described, according to the above embodiments of the present invention, with the provision of binarization means for the display and differential means for the detection of interframe change, it is possible to rapidly update the change portion in the display. In particular, by detecting the change between frames by differently weighting the components of signals RGB and YCbCr constituting the color for the detection of interframe change, it is possible to facilitate the extraction of a cursor with a luminance difference with respect to the surroundings, reduce the memory capacity for the detection of interframe change as well as the costs of the apparatus. Also, owing to subsampling the image signal, it is possible to attain the lower costs of the device, reduce the memory capacity for the detection of change point because of less sampling than the image size of display, and eliminate the noise contained in the analog signal by the use of a low pass filter, resulting in the improvement in detection precision of interframe change.

As above described, according to the present invnetion, it is possible to detect the moving portion of input image efficiently.

FLCD 30 (FIG. 2) used in the above embodiments is as described in U.S. Pat. No. 4,964,699, and composed of a ferroelectric liquid crystal having a memory function. This FLCD can rewrite a partial area of a frame in accordance with the output signal.

It will be understood that the present invention is not limited to the above embodiments, but various variations and modifications can be made within the scope of claims.

What is claimed is:

1. A display controlling apparatus comprising:

input means for inputting image data;

processing means for pseudo-halftone processing all of the input image data;

detection means for detecting partial movement of all of the image data input by said input means;

generation means for generating a control signal for performing a partial rewriting of a display in accordance with an output of said detection means; and output means for outputting the image data processed by said processing means to the display in accordance with the control signal.

2. A display controlling apparatus according to claim 1, wherein said input means inputs the image data from an external computer.

3. A display controlling apparatus according to claim 1, wherein the image data is analog data and further comprising an A/D converter for converting the analog data to digital data.

4. A display controlling apparatus according to claim 1, wherein the input image data is digital data for each pixel, and said detection means detects the partial movement of the image data by detecting a difference of the digital data between the pixels.

5. A display controlling apparatus according to claim 1, further comprising display means, having a liquid crystal, for displaying images.

6. A display controlling apparatus according to claim 5, wherein said liquid crystal has a memory function.

7. A display controlling apparatus according to claim 6, wherein said liquid crystal is a ferroelectric liquid crystal.

8. A display controlling apparatus according to claim 1, further comprising a display unit for displaying the display.

9. A display controlling apparatus comprising:

input means for inputting image data;

processing means for pseudo-halftone processing all of the image data input by said input means;

detection means for detecting partial movement of all of the image data input by said input means; and output means for outputting the image data processed by said processing means to the display, in accordance with an output of said detection means.

10. A display controlling apparatus according to claim 9, wherein said input means inputs the image data from an external computer.

11. A display controlling apparatus according to claim 9, wherein the image data is analog data and further comprising an A/D converter for converting the analog data to digital data.

12. A display controlling apparatus according to claim 9, wherein the input image data is digital data for each pixel, and said detection means detects the partial movement of the image data by detecting a difference of the quantized image data between the pixels.

13. A display controlling apparatus according to claim 9, further comprising display means, having a liquid crystal, for displaying images.

14. A display controlling apparatus according to claim 13, wherein said liquid crystal has a memory function.

15. A display controlling apparatus according to claim 14, wherein said liquid crystal is a ferroelectric liquid crystal.

16. A display controlling apparatus according to claim 9, further comprising a display unit for displaying the display.

17. A display controlling apparatus comprising:

input means for inputting color image data composed of a plurality of color component signals;

processing means for pseudo-halftone processing all of the input color component signals;

detection means for detecting partial movement of all of the color component signals input by said input means;

generation means for generating a control signal for performing a partial rewriting of a display in accordance with an output of said detection means; and output means for outputting the color component signals processed by said processing means to the display in accordance with the control signal.

18. A display controlling apparatus according to claim 17, further comprising converting means for converting the color component signals into a luminance signal and a chrominance signal.

19. A display controlling apparatus according to claim 18, further comprising sub-sampling means for performing a sub-sampling processing on the chrominance signal, and said detection means detects the movement on the basis of the chrominance signal sampling-processed by said sub-sampling means.

20. A display controlling apparatus according to claim 17, further comprising display means, having a liquid crystal, for displaying an image.

21. A display controlling apparatus according to claim 20, wherein said liquid crystal has a memory function.

22. A display controlling apparatus according to claim 21, wherein said liquid crystal is a ferroelectric liquid crystal.

23. A display controlling apparatus according to claim 17, further comprising a display unit for displaying the display.

24. A display controlling method comprising the steps of:

inputting image data;

pseudo-halftone processing all of the input image data;

detecting partial movement of all of the image data input in said inputting step;

generating a control signal for performing a partial rewriting of a display in accordance with an output of said detecting step; and outputting the image data processed by said processing step to the display in accordance with the control signal.

25. A display controlling method comprising the steps of:

inputting image data;

pseudo-halftone processing all of the image data input in said inputting step;

detecting partial movement of all of the image data input in said inputting step; and outputting the image data processed in said processing step to the display, in accordance with an output of said detection step.

26. A display controlling method comprising the steps of:

inputting color image data composed of a plurality of color component signals;

pseudo-halftone processing all of the input color component signals;

detecting partial movement of all of the color component signals input in said input step;

generating a control signal for performing a partial rewriting of a display in accordance with an output of said detecting step; and outputting the color component signals processed by said processing step to the display in accordance with the control signal.

27. An image processing apparatus comprising:

input means for inputting image data;

processing means for pseudo-halftone processing all of the input image data;

detection means for detecting partial movement of all of the image data input by said input means; and output means for outputting the image data processed by said processing means, in accordance with an output of said detection means.

28. An apparatus according to claim 27, wherein said input means inputs the image data from an external computer.

29. An apparatus according to claim 27, wherein said outputting means includes display means for displaying the image data processed by said processing means.

30. An apparatus according to claim 29, wherein said display means is a liquid crystal display.

31. An image processing apparatus comprising:

input means for inputting image data;

processing means for pseudo-halftone processing all of the input image data; and detection means for detecting changes between image data representing first and second successive image frames; and output means for outputting the image data processed by said processing means, in accordance with an output of said detection means.

32. An apparatus according to claim 31, wherein said input means inputs the image data from an external computer.

33. An apparatus according to claim 31, wherein said outputting means includes display means for displaying the image data processed by said processing means.

34. An apparatus according to claim 33, wherein said display means is a liquid crystal display.

35. An image processing method comprising the steps of:

inputting image data;

pseudo-halftone processing all of the input image data;

detecting partial movement of all of the image data input in said input step; and outputting the image data processed in said processing step, in accordance with an output of said detection step.

36. A method according to claim 35, wherein said outputting step includes a display step of displaying the image data processed in said processing step.

37. A method according to claim 36, wherein a liquid crystal display is used in said display step.

* * * * *

UNITED STATES PATENT AND TRADEMARK OFFICE

CERTIFICATE OF CORRECTION

PATENT NO. : 6,091,389

DATED : July 18, 2000

INVENTOR(S) : Mitsuru Maeda, et al.

It is certified that error appears in the above-identified patent and that said Letters Patent is hereby corrected as shown below:

COLUMN 9:

Line 57, "sig al. RGB" should read --signal. The RGB--.

COLUMN 10:

Line 34, ":he" should read --the--.
Line 39, "binarization" should read --binarized--.
Line 45, "cha ge" should read --change--.
Line 50, "can" should read --scan--.
Line 51, "i any," should read --if any,--.
Line 52, "unit 22" should read --unit 220--.
Line 53, "memory 20," should read --memory 210,--.
Line 60, "buffer 30," should read --buffer 130,--.

COLUMN 11:

Line 7, "1ike" should read --like--.
Line 9, "310" should read --2310--.
Line 18, "digit 1" should read --digital--.

COLUMN 15:

Line 15, "of from" should read --of 1s from--.
Line 42, "(n-2)-th" should read --(n-1)-th--.

UNITED STATES PATENT AND TRADEMARK OFFICE

CERTIFICATE OF CORRECTION

PATENT NO. : 6,091,389

DATED : July 18, 2000

INVENTOR(S) : Mitsuru Maeda, et al.

It is certified that error appears in the above-identified patent and that said Letters Patent is hereby corrected as shown below:

COLUMN 15 (con't.)

Line 52, "is" should read --1s--.

COLUMN 16:

Line 7, "210." should read --230.--.

COLUMN 19:

Line 12, "frames, it" should read --frames. Thus, it--.

COLUMN 24:

Line 20, "partial" should be deleted.
Line 55, "partial" should be deleted.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*